US006862503B2

(12) United States Patent
Dembosky et al.

(10) Patent No.: US 6,862,503 B2
(45) Date of Patent: Mar. 1, 2005

(54) WHEEL-RAILHEAD FORCE MEASUREMENT SYSTEM AND METHOD HAVING CROSS-TALK REMOVED

(75) Inventors: Mark A. Dembosky, Penrose, CO (US); Kevin D. Hass, Pueblo West, CO (US)

(73) Assignee: Transporation Technology Center, Inc., Pueblo, CO (US)

( * ) Notice: Subject to any disclaimer, the term of this patent is extended or adjusted under 35 U.S.C. 154(b) by 0 days.

(21) Appl. No.: 10/702,006

(22) Filed: Nov. 5, 2003

(65) Prior Publication Data

US 2004/0093133 A1 May 13, 2004

Related U.S. Application Data

(63) Continuation of application No. 10/128,568, filed on Apr. 24, 2002, now Pat. No. 6,675,077, which is a continuation-in-part of application No. 09/689,223, filed on Oct. 11, 2000, now Pat. No. 6,381,521.

(51) Int. Cl.[7] ..... G06F 3/00; G06F 7/00

(52) U.S. Cl. ..... 701/19; 701/20

(58) Field of Search ..... 701/19, 20; 246/167 R, 246/169 R

(56) References Cited

U.S. PATENT DOCUMENTS

| | | | |
|---|---|---|---|
| 5,368,260 | A | 11/1994 | Izbinsky et al. |
| 5,492,002 | A | 2/1996 | Higgins et al. |
| 6,227,122 | B1 | 5/2001 | Spencer |

FOREIGN PATENT DOCUMENTS

| | | | |
|---|---|---|---|
| EP | 000844462 | A2 * | 5/1998 |
| JP | 09318648 | * | 12/1997 |

OTHER PUBLICATIONS

J. J. Kalker, Review of Wheel–Rail Rolling Contact Theories, The General Problem of Rolling Contact AMD—vol. 40, pp. 77–92, The American Society of Mechanical Engineers, New York, NY.

Duane E. Otter and Robert W. Martin, Rugged Transducers for Measurement of Angle of Attack and Lateral Railhead Displacement, Technology Digest, Aug. 1992, TD 92–010.

Stephen E. Mace, Robert W. Martin, Ruben D. Pena and Kerry Hopkins, New Vehicle Mounted Angle of Attack Measurementsystem, Technology Digest, Feb. 1995, TD 95–004.

* cited by examiner

*Primary Examiner*—Yonel Beaulieu
(74) *Attorney, Agent, or Firm*—Dorr, Carson, Sloan, Birney & Kramer, P.C.

(57) ABSTRACT

A system and method for removing cross-talk in measured forces between a railway wheel set and the railhead of underlying track such as found in angle of attack measurements for shallow curvature track. The angle of attack for the leading and trailing sets of wheels in trucks of rail vehicles is measured traveling over track in a wayside system. At a first point on the outside rail of a track vertical force is measured with a first vertical strain gage, lateral force is measured with a first lateral strain gage and an outside angle of attack timing signal is measured with a first angle of attack strain gage. This process is repeated on the inside track so that a raw angle of attack for each set of wheels can be determined based upon speed and time difference. Position signals obtained from position strain gages are used to remove cross-talk thereby improving accuracy. The sensed position signals are calibrated to known forces on the railhead.

19 Claims, 15 Drawing Sheets

10
14
12
630
600
620
16
AOA0
640
610
650
80

Fig. 14 (a)
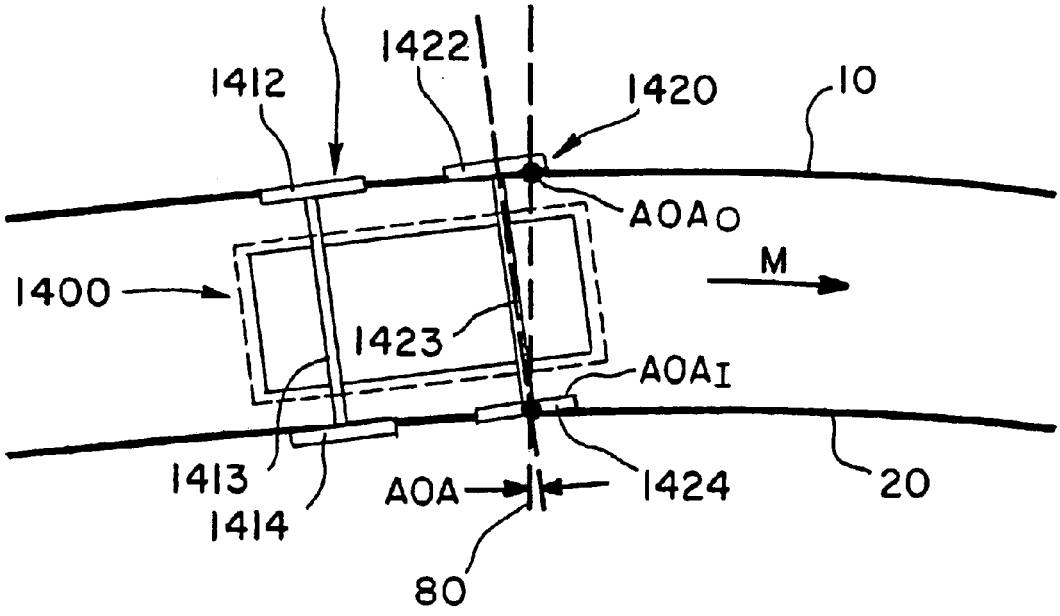
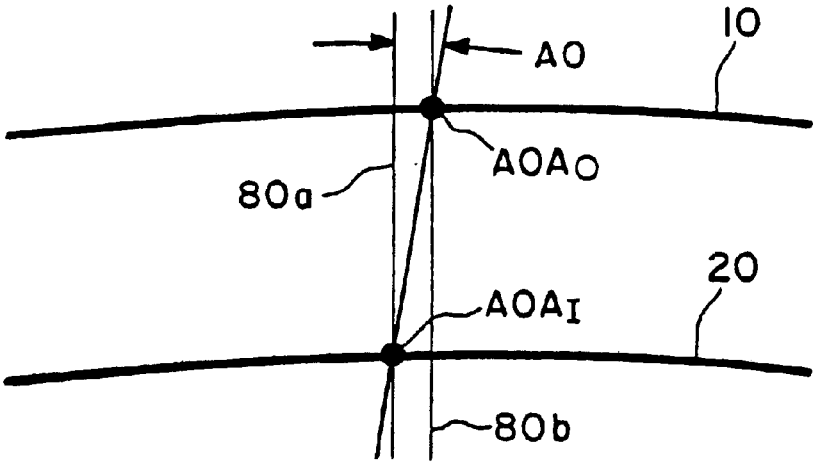
Fig. 14(b)

CROSS TALK MATRIX $$\begin{bmatrix} \text{Signal } F_V \\ \text{Signal } F_L \\ \text{Signal POS} \end{bmatrix} = \begin{bmatrix} a_{VV} & a_{VL} & a_{VP} \\ a_{LV} & a_{LL} & a_{LP} \\ a_{VP} & a_{LP} & a_{PP} \end{bmatrix} * \begin{bmatrix} F_V \\ F_L \\ POS \end{bmatrix}$$

*Fig.16*

INVERSE OF CROSS TALK MATRIX $$\begin{bmatrix} F_V \\ F_L \\ POS \end{bmatrix} = \begin{bmatrix} a_{VV} & a_{VL} & a_{VP} \\ a_{LV} & a_{LL} & a_{LP} \\ a_{VP} & a_{LP} & a_{PP} \end{bmatrix} * \begin{bmatrix} \text{Signal } F_V \\ \text{Signal } F_L \\ \text{Signal POS} \end{bmatrix}$$

*Fig.17*

WHEEL-RAILHEAD FORCE MEASUREMENT SYSTEM AND METHOD HAVING CROSS-TALK REMOVED

RELATED INVENTION

This application is a continuation of U.S. patent application Ser. No. 10/128,568 filed Apr. 24, 2002, now U.S. Pat. No. 6,675,077 which is a continuation-in-part of DYNAMIC ANGLE OF ATTACK MEASUREMENT SYSTEM AND METHOD THEREFOR; U.S. patent application Ser. No. 09/689,223 filed Oct. 11, 2000 now U.S. Pat. No. 6,381,521 issued Apr. 30, 2002.

BACKGROUND OF THE INVENTION

1. Field of the Invention

The present invention pertains to a system and method for measuring the forces, with high accuracy, between a railway wheel set and the railhead of underlying track such as the angle of attack when the track undergoes a shallow curve.

2. Statement of the Problem

The interaction between a set of railway wheels and the underlying track has been extensively studied. The angle of attack (AOA) is generally defined as the yaw angle between the wheels and the rails. AOA is a critical factor for assessing rail vehicle performance. For example, during curve negotiation, a larger value of AOA indicates a potential for the wheel set to climb the rails or to generate large gage spreading forces. In FIG. 1, a set 100 of wheels 40 and 50 are connected to axle 30 and moves M in the direction shown on outside rail 10 and inside rail 20. The leading wheel 50 is on outside rail 10 and the trailing wheel 40 is on inside rail 20. One measurement of angle of attack is the angle ($AOA_1$) between the plane 60 of wheel 50 and the tangent 70 to the outside rail 10 upon which the leading wheel 50 is engaged. Angle of attack is also shown by the angle ($AOA_2$) between line 80 which is normal to the tangent 70 and the axle centerline 90.

When AOA is zero, the rotational velocity 110 of the wheel set has equal magnitude and direction as the translational velocity 120 of the railway vehicle to which the wheel set is attached. This results in pure rotation of the wheels which converts to pure forward velocity of the railcar attached to the wheels. At the other extreme where AOA is large, the translational velocity 120 of a railroad vehicle is due to the rotational velocity 110 plus a lateral velocity 130 as shown in FIG. 1. In this scenario, the lateral forces $F_L$ which are a function of the lateral velocity 130 on wheel 50 as shown in FIG. 2 are great which may result in damage, higher maintenance, or possible derailment. FIG. 2 also shows the vertical force, $F_V$ of the wheel 50, on the outside rail 10.

In FIG. 3, the conventional relationship between AOA, $F_L$ and $F_V$ is generally illustrated as curve 300. Curve 300 is well known such as found in the following reference: Kalker, "Review of Wheel-Rail Rolling Contact Theories," pages 77–92 of The General Problem of Rolling Contact AMD-40 Published by The American Society of Mechanical Engineers. AOA appears on the horizontal scale and the ratio of the $F_L$ to $F_V$ is shown on the vertical scale. When $F_L$ is zero and AOA is zero, the rotational velocity of the wheel set is converted directly to the forward velocity of the rail vehicle. This is shown as 310 in FIG. 3. In region 330, lateral creepage occurs, and the lateral forces, $F_L$, increase as the value of AOA increases. Lateral creepage can be defined as translational velocity 110 minus lateral velocity 120 as a percent of translational velocity 100. In region 320, the amount of friction between the wheel and the surface of the rail causes gross slippage to occur. Normally the ratio of $F_L$ to $F_V$ saturates at u, the coefficient of friction 350 for curve 300. Curve 340, for example, can be a lubricated set of rails that has a lower coefficient of friction.

In FIG. 1, the track 10, 20 has a curvature and the AOA increases proportionally with the curvature. One rule of thumb for North American three-piece trucks approximates the degree of curvature for the track to the AOA in milliradians. For example, on a six degree curve, the leading axle has an AOA of six milliradians. For shallow curves (i.e., two degrees or less such as a radius greater than 1000 meters), the lateral forces are smaller since the AOA is small. One difficulty in measuring AOA in shallow curves is the presence of cross-talk. Cross-talk is caused by the vertical load on the railhead and by the shape of the railhead. Curves of four degrees or greater, result in more accurate lateral force measurements as cross-talk is minimal (as found with AAR130 rail and normal lateral prone three-piece trucks).

Systems are available which measure AOA. U.S. Pat. No. 5,368,260 uses a wayside range finder that incorporates a beam of laser light directed to the wheel so as to measure $AOA_1$ between the plane 60 of the wheel and the tangent 70 of the track 10 as shown in FIG. 1. In order to do this, wheel detectors are placed on the track so that passage of a wheel can be detected which start and stop the range finder. In addition, an average velocity measurement occurs. The range finder generates a complete profile image as each wheel passes the wayside range finder. From this image, AOA is calculated. One such system, Wayside Inspection Devices, Inc., 4390 De Maisonneuve, Westmount, Quebec H3Z 1L5 Canada, uses lasers precisely positioned on the wayside of a track to carefully determine AOA based on reflected laser light. These systems claim to accurately provide angle of attack measurements within one milliradian (i.e., 3.44 arc minutes). Such systems, however, are expensive, require continued maintenance and supervision, and are prone to vandalism.

Another prior art approach uses a pair of vertical strain gages to measure the passage of a set of wheels over the rails at the position of the strain gage. Offer and Martin, Rugged Transducers for Measurement of Angle of Attack and Lateral Railhead Displacement, Technology Digest, August, 1992 (TD 92-010). The use of strain gages in an AOA measurement system results in a much less expensive system, one that is easy to maintain, and one that is not easily vandalized in comparison to laser systems. Such strain gage systems, however, do not have the accuracy in measuring AOA as laser systems and usually results in an accuracy of 3–4 milliradians.

In addition to the systems discussed above, AOA has also been measured with a vehicle-mounted system for a particular wheel set as the rail vehicle travels on the track. Mace et al., New Vehicle-Mounted Angle of Attack Measurement System, Technology Digest, February 1995 (TD 95-004). These systems are mounted to each wheel set and, therefore, are not suitable for wayside use for determining AOA for all wheel sets in a train.

The known optical, laser, and strain gage wayside systems and methods for measuring angle of attack result in a static AOA measurement which does not take into account the dynamic misalignment of the rails as the wheel sets pass over or when misalignment of the wayside measuring system occurs due to soil, rail, or tie shifting due to moisture, temperature, lateral train forces, etc.

A need exists for a system and method for measuring AOA which is inexpensive, rugged, less prone to vandalism, easier to maintain, and yet provides an AOA measurement over a range of ±50 milliradians with an accuracy of 1 to 3 milliradians. Furthermore, a need exists for such a system and method to dynamically measure AOA so as to compensate for any misalignment. Finally, a need exists to improve upon the earlier conventional approach using strain gages by better predicting when the wheel set crosses directly over the AOA strain gages.

A further need exists to remove cross-talk in shallow curves for AOA measurement systems to improve the accuracy of measurements. While the above is directed towards AOA measurement systems, it is to be understood that a need exists to remove cross-talk from any system and method measuring the forces between a railway wheel set and the railhead of underlying track.

SUMMARY OF THE INVENTION

1. Solution to the Problem

The present invention through its unique system and method solves the aforesaid needs by measuring AOA with an inexpensive and rugged system that is less prone to vandalism and is easier to maintain. The present invention further removes cross-talk in systems and methods for measuring forces between a railway wheel set and the railhead of underlying track such as in AOA measurements for shallow curvature track. The removal of cross-talk provides high accuracy to the forced measurements.

2. Summary

A system and method is set forth for measuring AOA for the leading and trailing sets of wheels in trucks of rail vehicles traveling over track. The method includes obtaining an accurate measurement of the angle of attack by taking a derivative of the angle of attack time sample data, locating peaks in the derivative and determining the angle of attack value based upon the located peaks. This method precisely locates the passage of a railway wheel over the angle of attack sensors.

Another aspect of the present invention, a system and method is presented for determining raw angles of attack for all sets of wheels, selecting only those raw angles of attack that have trucks on the track within a predetermined range of lateral to vertical force ratios indicating proper steering, calculating a dynamic angular offset value based on the selected raw angles of attack and then subtracting the dynamic angular offset value from all raw angles of attack so as to arrive at a dynamic angle of attack for each wheel set.

In more particular, the system and method of the present invention provides the following. At a first point on the outside rail of a track, vertical force is measured with a first vertical strain gage, lateral force is measured with a first lateral strain gage and an outside angle of attack timing signal is measured with a first AOA strain gage. This process is repeated on the inside track so that a raw angle of attack for each set of wheels can be determined based upon speed. Ratios between the lateral force and the vertical force for the outside wheels are used to select raw angle of attack values for properly tracking trucks that are averaged together to obtain an average angular offset value related to any misalignment. A dynamic angle of attack for each set of wheels is obtained by subtracting the average angular offset value from each raw angle of attack value to obtain a dynamic angle of attack value for each set of wheels.

A system and method is set forth for removing cross-talk in systems and methods for measuring forces between a railway wheel set and the railhead of underlying track such as found in, but not limited to, AOA measurements for shallow curvature track.

BRIEF DESCRIPTION OF THE DRAWINGS

FIG. 11(*b*) sets forth the measurement of lateral force occurring at the same time the vertical force is measured in FIG. 11(*a*).

FIG. 12(*b*) sets forth the measurement of the lateral force corresponding to the wheels measured in FIG. 12(*a*).

FIG. 13(*b*) is the determination of the derivative peak for FIG. 13(*a*).

FIG. 14(*a*) illustrates the determination of the angle of attack for truck containing two wheel sets.

FIG. 14(*b*) illustrates the possible misalignment between the AOA gages on opposing rails.

FIG. 16 sets forth the mathematical matrix relationships to determine the signals of the present invention.

FIG. 17 sets forth the inverse mathematical matrix relationships of FIG. 16.

DETAILED DESCRIPTION OF THE INVENTION

1. Overview of System

Figure 1:
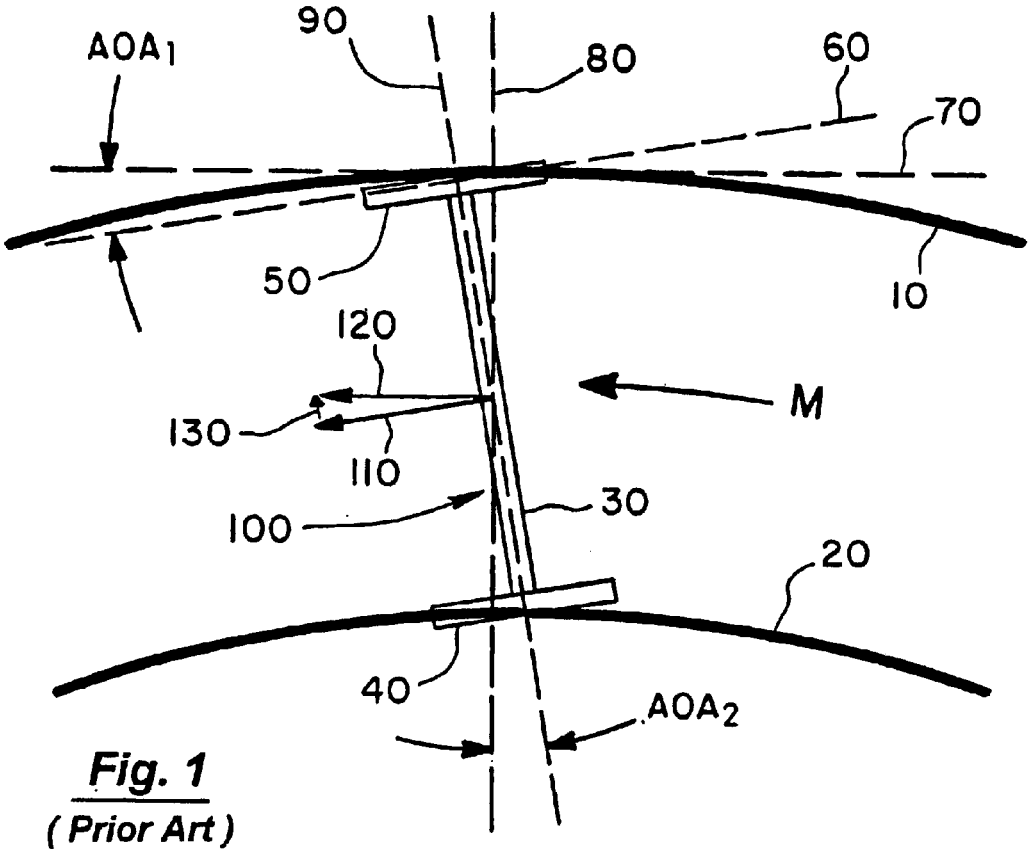
Fig. 1 (Prior Art)
FIG. 1 illustrates the prior art angle of attack between a set of wheels and track.
Figure 2:
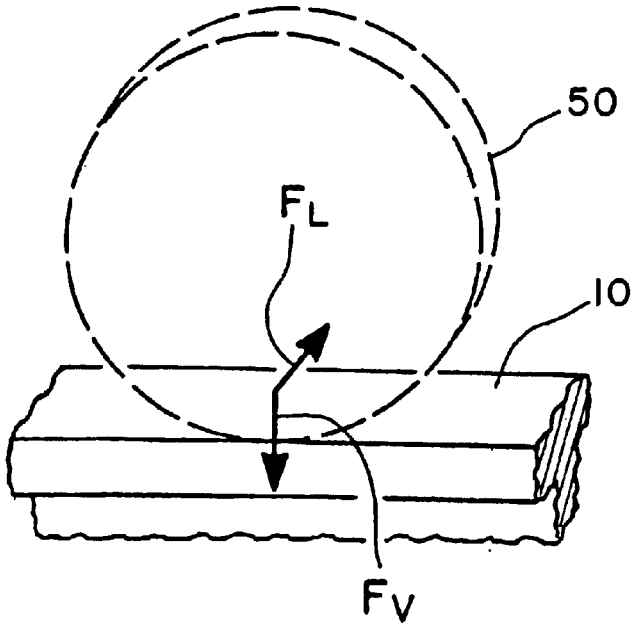
Fig. 2 (Prior Art)
FIG. 2 sets forth the prior art relationship between a wheel and a rail with respect to lateral and vertical forces.
Figure 4:
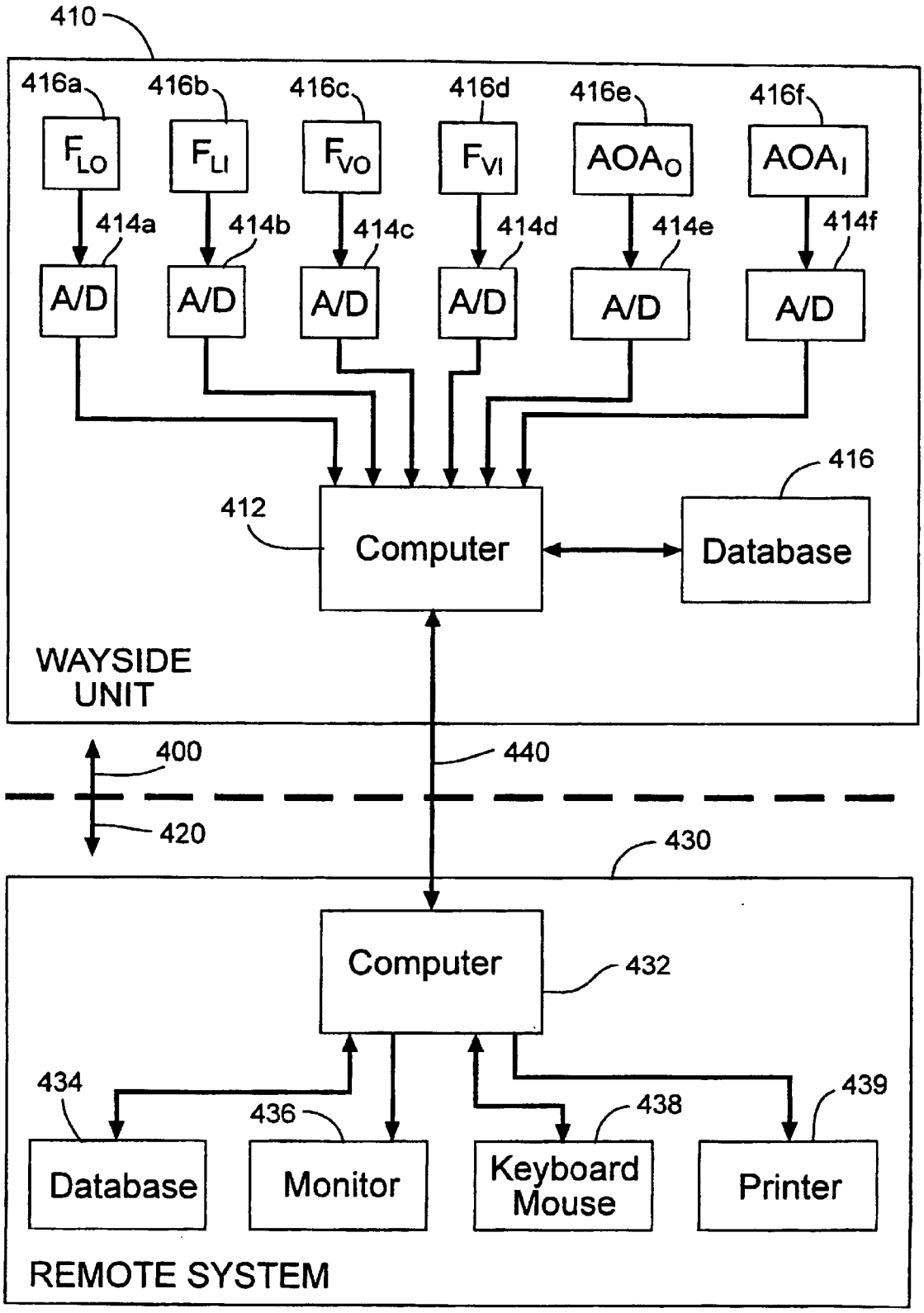
FIG. 4 is a block diagram representation of the system of the present invention.

In FIG. 4, the overall system block diagram, of one embodiment of the present invention, is set forth. Located 400 to the rails 10 and 20 of FIG. 1, is a wayside unit 410. Located remote 420 to the wayside unit is a remote system 430. The wayside unit 410 communicates 440 with the remote system 430 by any of a number of conventional communication paths. For example, but not intended to limit the scope of the invention, communication path 440 could be a wireless path such as a radio link, cellular path or a satellite uplink. Communication path 440 could also be a hardwire communication link. The wayside unit 410 is designed to be ruggedized, weatherproof and vandal resistant. It is also designed to operate in wide temperature and humidity swings and in an environment having significant vibration and electrical noise. The remote system 430 can be located at any suitable location and can comprise any suitable computer configuration including being another wayside unit.

The wayside unit 410 includes a computer 412 receptive of signals from analog to digital converters (A/D) 414*a*, 414*b*, 414*c*, 414*d*, 414*e*, 414*f*, 414*g*, and 414*h*. These A/D converters 414 receive signals from the following strain gages mounted on outside rail 10 or inside rail 20: $F_{LO}$ (lateral strain gage "outside"), $F_{LI}$ (lateral strain gage "inside"), $F_{VO}$ (vertical strain gage "outside"), $F_{VI}$ (vertical strain gage "inside"), $AOA_0$ (angle of attack strain gage "outside"), $AOA_I$ (angle of attack strain gage "inside"), POSo (position strain gage outside), and POSi (position strain gage inside). These digital values are processed by computer 412 for storage in a local database 416. This database 416 can permanently or temporarily store these values. Computer 412 may preprocess the digital values from the converters 414 for storage or it may fully process these digital values.

At the remote system 430 is a computer 432 which is in communication over communication path 440 with computer 412 of the wayside unit 410. Many different communication protocols can be utilized to provide this communication. The communication over path 440 can be periodic, aperiodic, based upon a call up protocol, etc. Computer 432 accesses database 434 and may optionally be interconnected to a conventional monitor 436, a conventional keyboard (or mouse or touch screen) 438 or a conventional printer 439. It is to be expressly understood that these peripheral devices 436, 438, 439 may comprise any suitable peripheral devices for providing input of commands, signals, etc. from a user into the computer 432 and to provide output of information therefrom. Indeed, computer 432, in turn, can use another communication path to communicate with one or more remote systems (not shown) such as by over the Internet. The wayside unit 410 and remote system 430, as shown in FIG. 4, is only one of many processing embodiments that can be utilized to incorporate the teachings of the present invention.

2. Details of Strain Gage Placement

Figure 5:
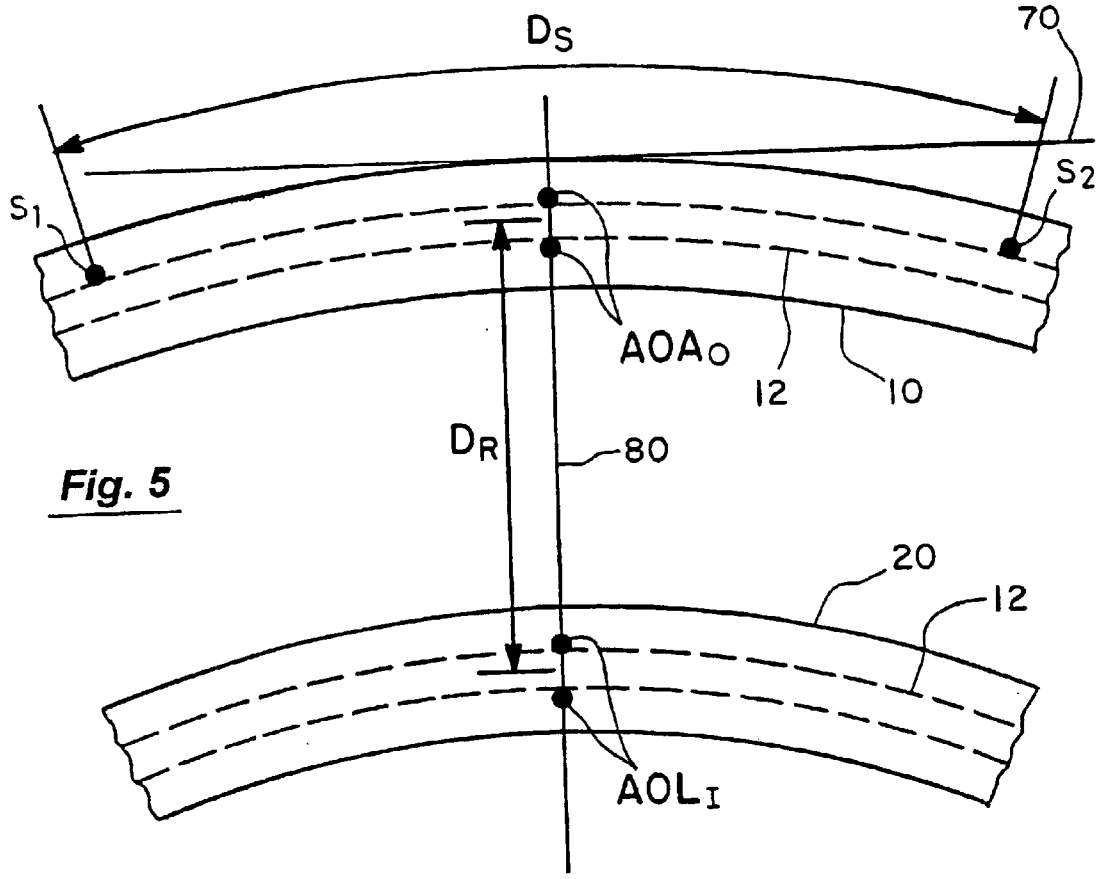
FIG. 5 illustrates the placement of angle of attack strain gages on the outside and inside rails.

The following sets forth the details of how the strain gage sensors are placed onto conventional track. In FIG. 5, the outside rail 10 and the inside rail 20 have the $AOA_O$ and $AOA_I$ strain gages mounted as shown. They are mounted along line 80 which is normal to the tangent line 70 of the outside rail 10 and separated by distance $D_R$ from the inside rail 20.

Figure 6:
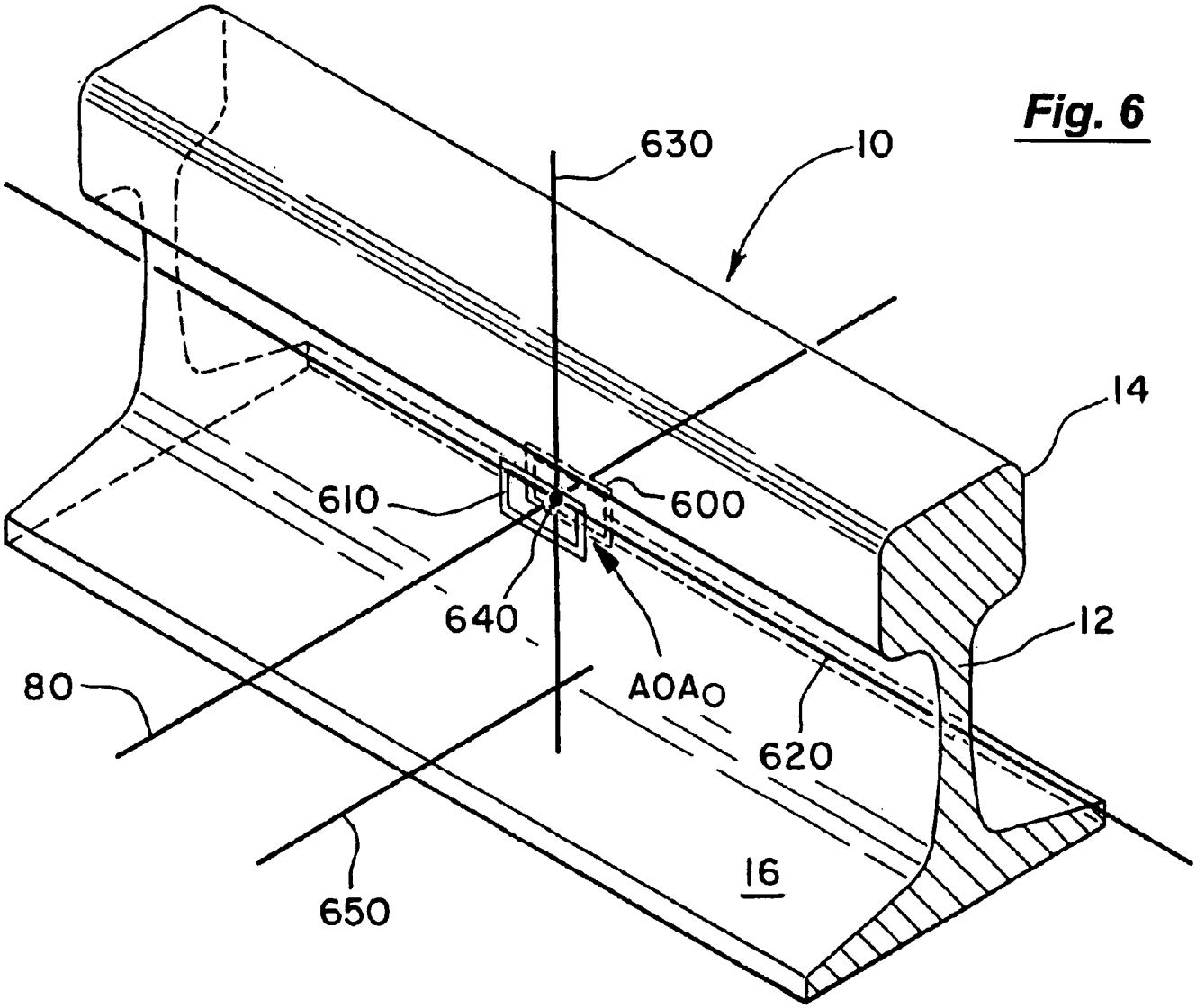
FIG. 6 sets forth the placement of the angle of attack strain gages to a rail.

In FIG. 6, outside track 10 is shown with the $AOA_O$ strain gages 600 and 610 on opposite sides of the rail web 12 between the railhead 14 and the rail base 16. The strain gages 600 and 610 are located on center with perpendicular line 80 (as shown in FIGS. 1 and 5). Preferably the strain gages are environmentally rugged shear gages welded to the rail. Line 620 is the neutral axis for rail 10 and line 630 is normal to lines 80 and 620. Hence, the $AOA_0$ pair of strain gages 600 and 610 are precisely located at the intersection of lines 80, 620, and 630 as shown in FIG. 6. This intersection is identified as point 640. The gages 600 and 610 are mini-welded/bonded to rail 10 and protected by waterproofing and protective covers. The AOA strain gages are electrically connected to issue an $AOA_O$ signal which is delivered to A/D circuit 414*e*. The $AOA_I$ pair of gages, not shown, are oriented and placed on inside rail 20 on line 80 in the same fashion as shown in FIG. 6 and to issue signal $AOA_I$ for delivery to A/D circuit 414*f*. The strain gages $AOA_O$ and $AOA_I$ can be any suitable transducer design capable of sensing vertical shear forces as a wheel passes over point 640.

Figure 7:
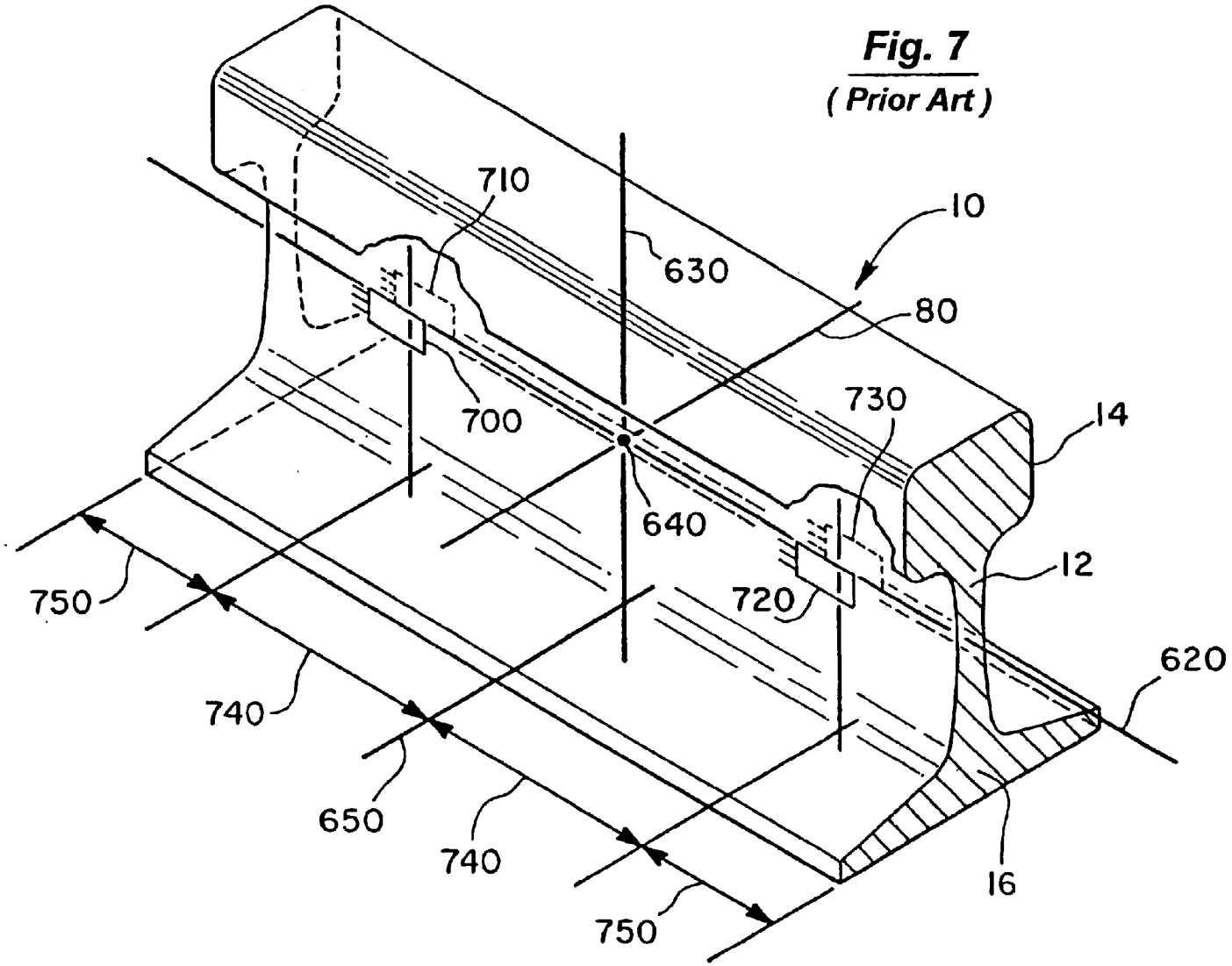
Fig. 7 (Prior Art)
FIG. 7 sets forth the prior art placement of the vertical strain gages to a rail.

In FIG. 7, prior art vertical strain gages for $F_{VO}$ are shown for outside track 10. The vertical strain gage comprises four separate strain gages 700, 710, 720, and 730. Strain gages 700 and 710 are mounted in opposing relationship on opposite sides of the rail web 12 as are strain gage pair 720 and 730. Strain gage pairs 700, 710 and 720, 730 are centered over neutral axis 620. In a preferred embodiment, each strain gage pair is located the same predetermined distance 740 from line 650 which is the center of the crib (i.e., the line between two adjacent ties) such as from about 3.5 inches to 8.5 inches with about a five-inch nominal spacing. The strain gage pairs are also located from the tie plate, not shown, a minimum distance 750 such as at least two inches from the tie plate, not shown. This placement is important as flexure of the rail occurs between the ties. The strain gages are electrically connected to issue an $F_{VO}$ signal to A/D circuit 414*c*. The vertical strain gages for the inside rail 20, not shown, are oriented and placed on the inside rail about line 80 in the same fashion and are electrically connected to issue signal $F_{VI}$ to A/D circuit 414*d*.

Figure 8:
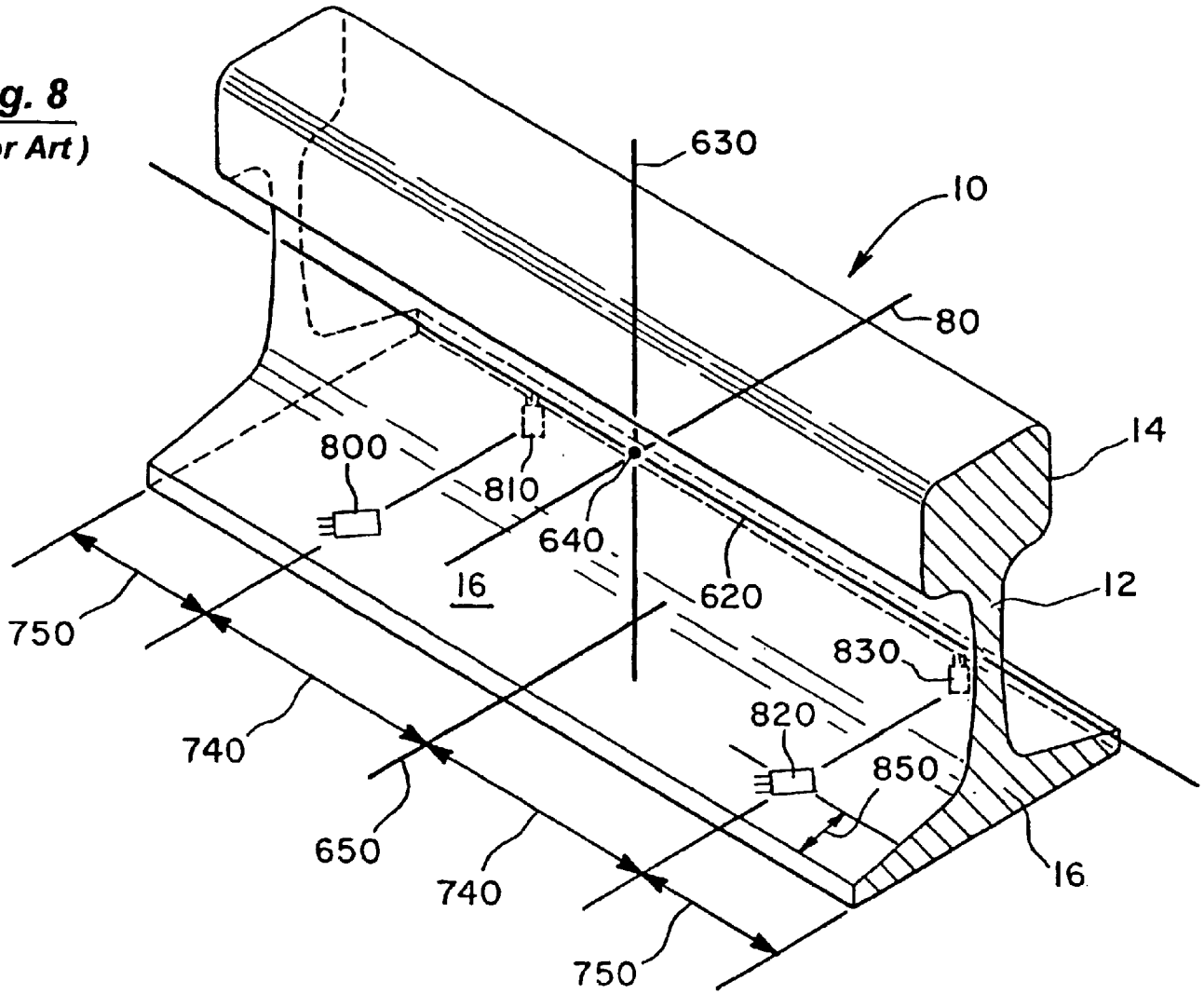
Fig. 8 (Prior Art)
FIG. 8 sets forth the prior art placement of lateral strain gages to a rail.

In FIG. 8, the mounting of the lateral strain gages for $F_{LO}$ on the outside rail 10 are shown. Strain gage pair 800, 810 are mounted on opposite sides of the rail base 16 as are strain gage pair 820, 830. Each strain gage pair is located a predetermined distance corresponding to the distance 740 discussed above for the vertical strain gage pairs from the crib centerline 650. They are also located a predetermined distance corresponding to distance 750 above. These gages are electrically connected to issue an $F_{LO}$ signal for delivery to A/D circuit 414*a*. The vertical strain gages for the inside rail 20, not shown, are oriented and placed on the inside rail about line 80 in the same fashion and are electrically connected to issue signal $F_{LI}$ for delivery to A/D circuit 414*b*.

Figure 15:
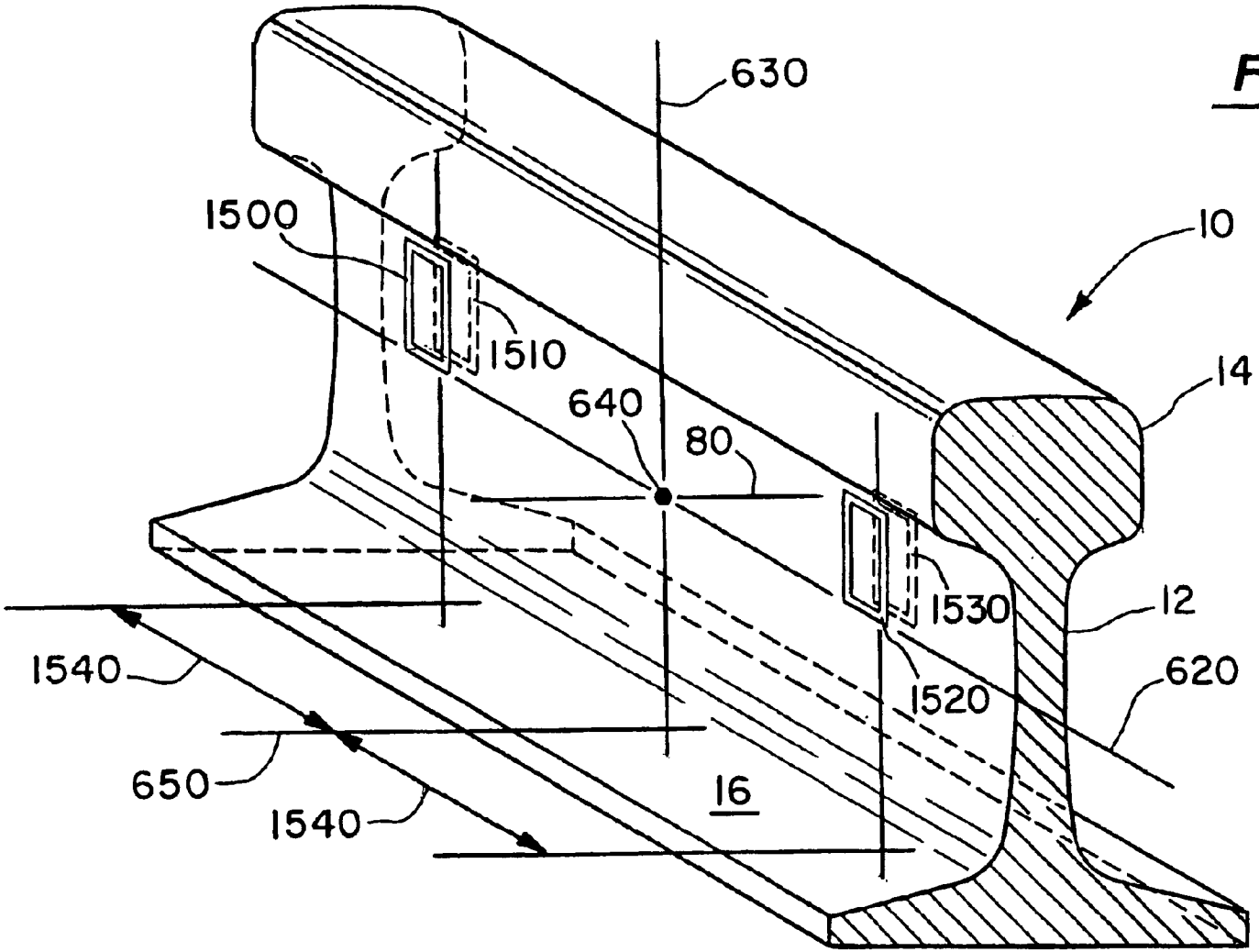
FIG. 15 sets forth the placement of the position strain gages to a rail.

In FIG. 15, the mounting of the position strain gages for POSo on the outside rail 10 are shown. Strain gage pairs 1500 and 1510 are mounted on opposite sides of web 12 as are strain gage pairs 1520 and 1530. Each strain gage pair is located a predetermined distance 1540 from the centerline 630 such as five inches (any suitable distance, but preferably greater than three inches). As shown in FIG. 4, these gages are the sensor for POSo are connected to A/D circuit 414*g*. The position strain gages POSi for the inside rail, not shown, are oriented and placed on the inside rail 20 in the same fashion for delivery of signals to AID circuit 414*h*.

In reference to FIGS. 6, 7, 8, and 15 the strain gage sensors for measuring $F_V$, $F_L$, AOA and POS are all centered about point 640 on line 80 for both rails. These sensors are precisely installed on the rails 10 and 20 under the teachings of the present invention.

How the signals from the various strain gages are delivered from rails 10 and 20 to the wayside unit 410 can comprise any of a number of different approaches and how this is accomplished is not material to the teachings of the present invention. In the preferred embodiment the A/D circuits are located on a board in the wayside unit 410. In variations, the A/D circuits 414 could be located elsewhere including on the track.

The present invention requires speed S to be determined. In FIG. 5 and, in one conventional approach, two strain gages $S_1$ and $S_2$ are mounted to the web 12 as shown to detect when a wheel passes overhead. As the distance $D_S$ is known between the two strain gages S1 and S2, the speed S of a wheel can be conventionally determined. Any of a number of conventional techniques for measuring speed can be utilized under the teachings of the present invention. A preferred embodiment using the strain gages of the present invention is discussed later with respect to FIG. 10.

In summary, the preferred embodiment for placing the strain gages of the present invention onto the track has been shown in FIGS. 5–8. It is to be expressly understood that any conventional strain gage transducer can be utilized under the teachings of the present invention adaptable for the environment of a railway. Furthermore, any suitable electrical connection between the strain gage sensors and their corresponding A/D converters could be utilized under the teachings of the present invention.

3. Method of Operation

The following sets forth the method of operation, in one preferred embodiment, of the present invention. As will be set forth, the method of operation of the present invention includes a unique approach to more accurately determining when a wheel passes directly over an AOA strain gage at point 640 and provides a unique process for determining any offset values due to misalignment of the strain gages in order to arrive at a dynamic angle of attack value.

Figure 9:
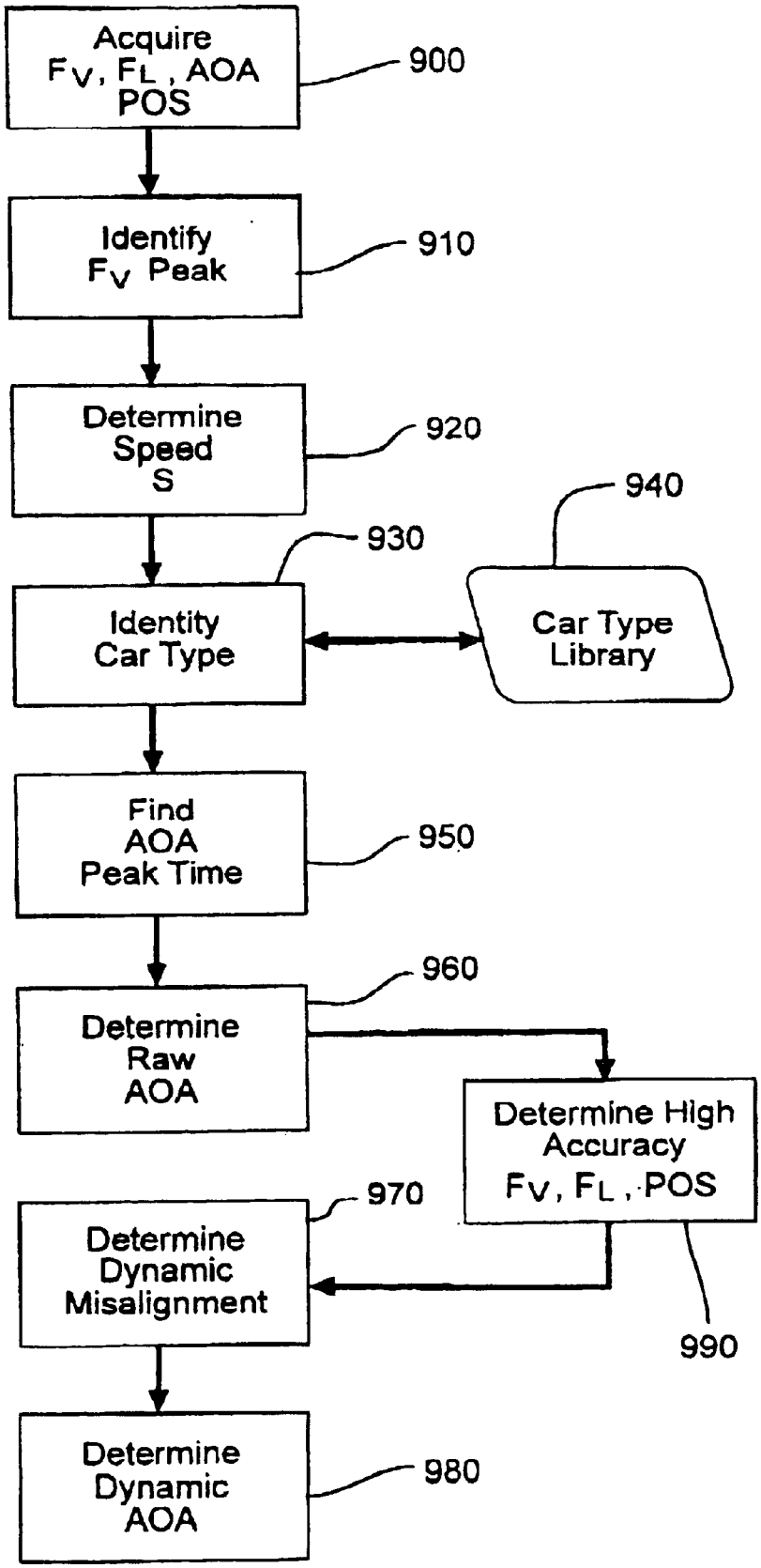
FIG. 9 sets forth the system functional components in a flow chart for the method of the present invention.

In FIG. 9, the method of determining the angle of attack values, in a preferred form, is set forth. In stage 900 the computer, preferably computer 432, acquires the $F_{VO}$, $F_{VI}$, $F_{LO}$, $F_{LI}$, $AOA_O$ $AOA_I$, POSo, and POSi values from database 434. It is to be expressly understood that through conventional processes, these values were delivered into database 434 from computer 432. These values correspond to the strain gage outputs 416*a*, 416*b*, 416*c*, 416*d*, 416*e*, 416*f*, 416*g*, and 416*h*. These are obtained as time sample data from the A/D converters 414. All of these strain gages 416 have been calibrated against known forces.

Figure 10:
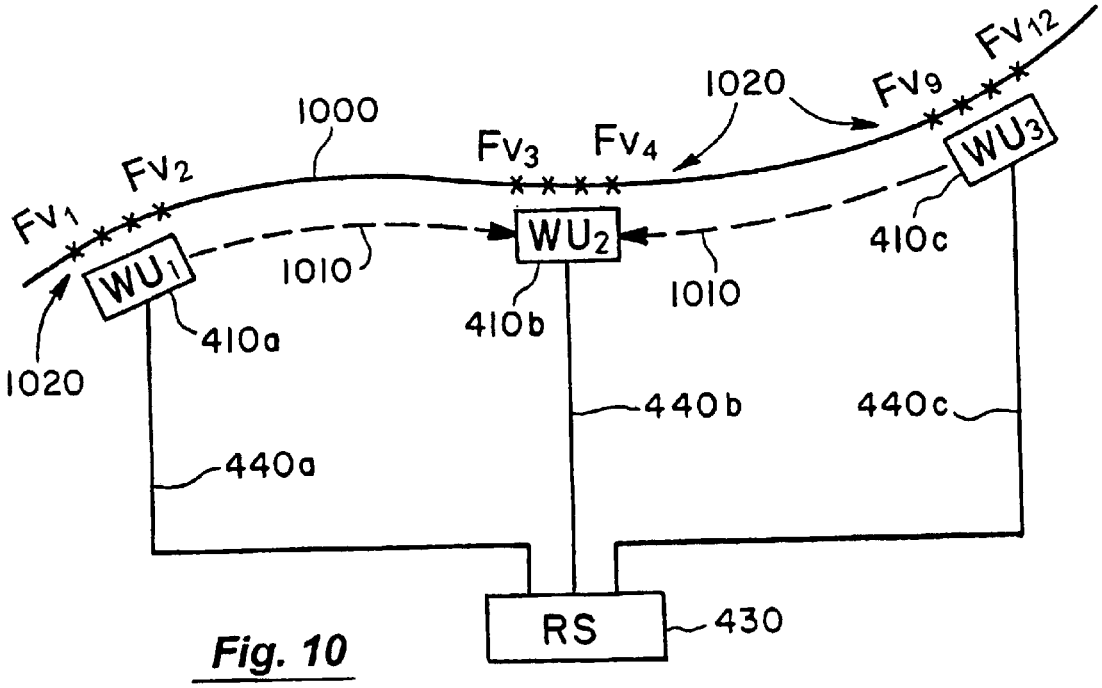
FIG. 10 sets forth an illustration for determining the speed.

In a preferred application of the present invention, several wayside units 410*a*, 410*b*, and 410*c* are spaced along the track 1000 separated by known distances. This is shown in FIG. 10 and the wayside units (WU) communicate over paths 440 to a remote system 430. It is to be expressly understood that any number of wayside units (WU) located a suitable desired distances could be used and that the teachings of the present invention are not limited to that shown in FIG. 10.

The computation of the speed S of the train can be made based upon the existing strain gages $F_L$, $F_V$ and AOA either individually or in combination with each other. In FIG. 10, and in the preferred embodiments, vertical strain gages $F_V$ are used to target speed S. This eliminates use of separate strain gages 416*e* as previously discussed in the embodiment shown in FIG. 5. Again, it is to be expressly understood that the speed S can be measured in any suitable conventional fashion including the two approaches specifically discussed herein.

Several "cribs" 1020 of gages, located a known distance apart are used. A "crib" contains at minimum, a set of vertical ($F_V$) and lateral ($F_L$) force gages on both inside 20 and outside 10 rails. The speed S is computed from the distance between these "cribs," and the time it took each wheel to cross the vertical gages. Each vertical gage is processed to find the time point when the vertical force was maximum. The difference in time for the wheel to pass two vertical gages, is found from this data. A wayside system (410) may have several "cribs" 1020 of gages directly connected. At least one "crib" has a pair of AOA gages.

In another variation, three separate wayside systems (410) can be placed at great distances apart. Each wayside system has at least two or more "cribs." Each system sends its data to one of the wayside systems, which acts as the main data reduction system.

In yet another embodiment, the wayside units of FIG. 10 could communicate with other wayside units over paths 1010 (shown in dotted lines). In this embodiment $WU_1$ and $WU_3$ do not have communication paths 440*a* and 440*c* to the remote system 430. Many variations are possible under the teachings of the present invention. As one variation, $WU_2$ could act as a remote system communicating directly with $WU_1$ and $WU_3$ and eliminating the remote system 430. Further, a wayside system may include a number of wayside units.

Figure 11:
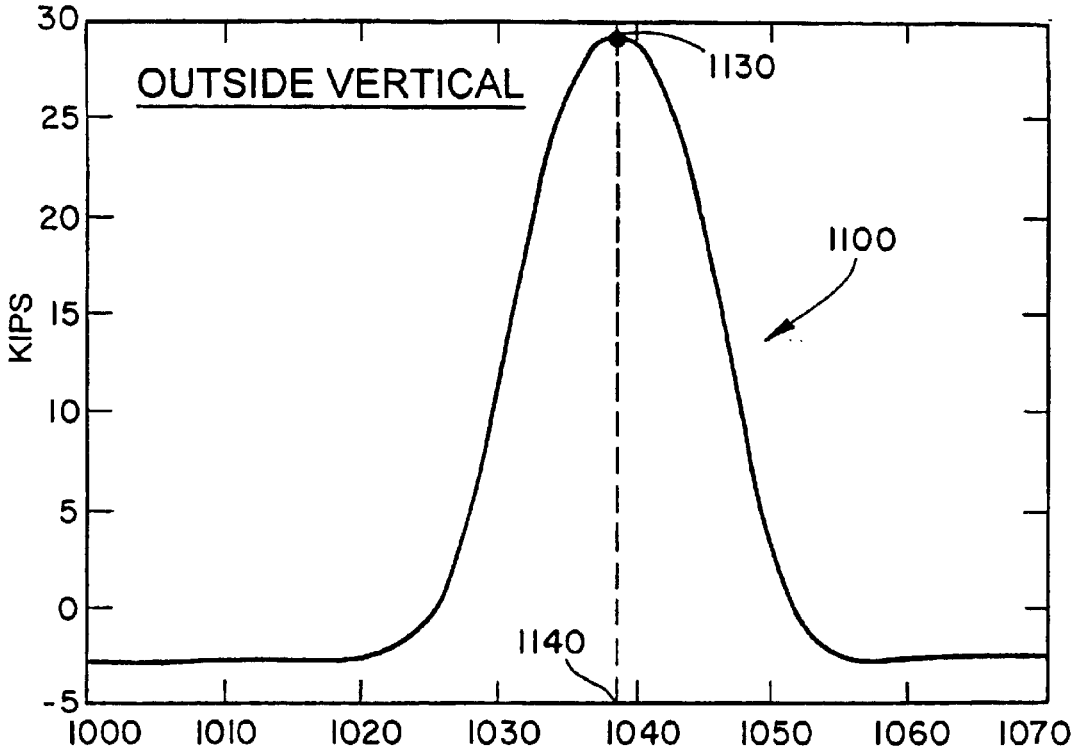
FIG. 11(*a*) sets forth the measurement of vertical force.
Figure 11:
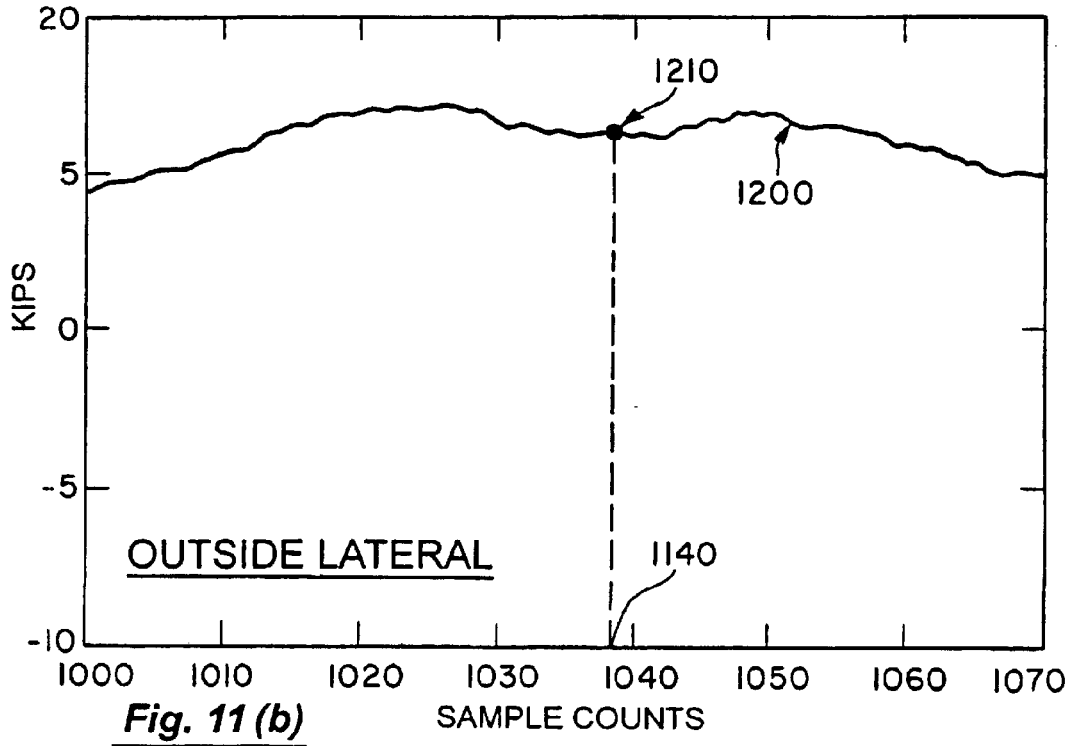
Figure 12:
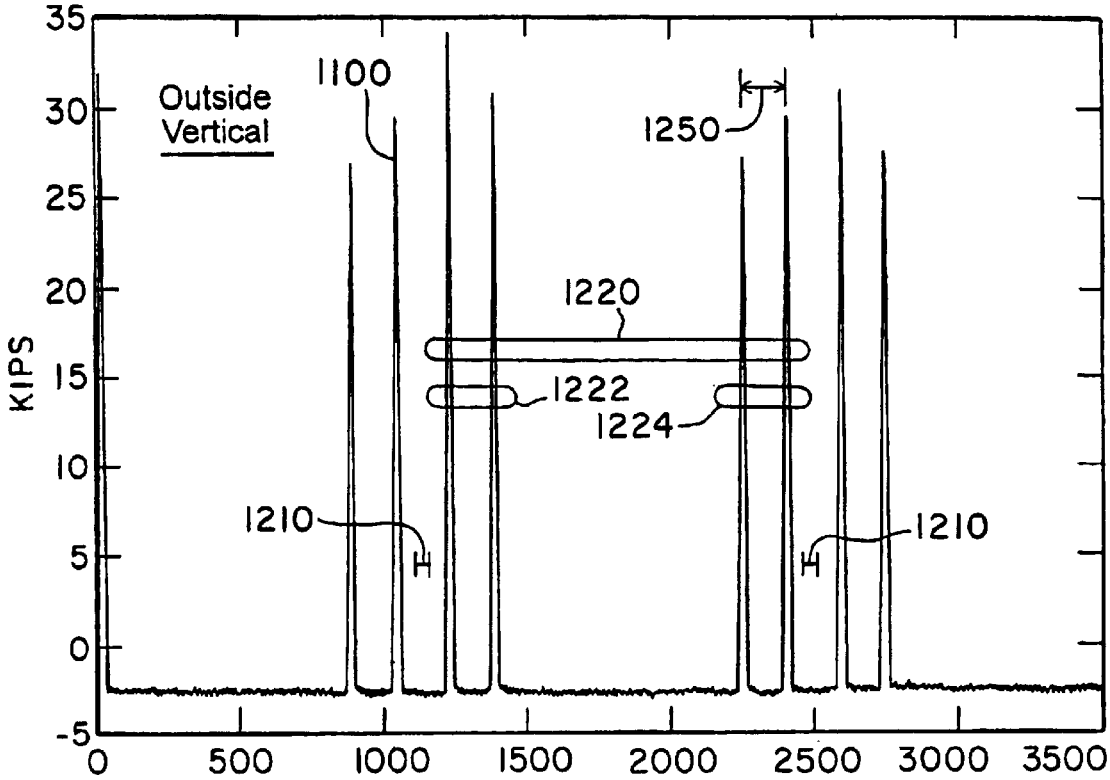
FIG. 12(*a*) illustrates the measurement of vertical force for a plurality of wheels.
Figure 12:
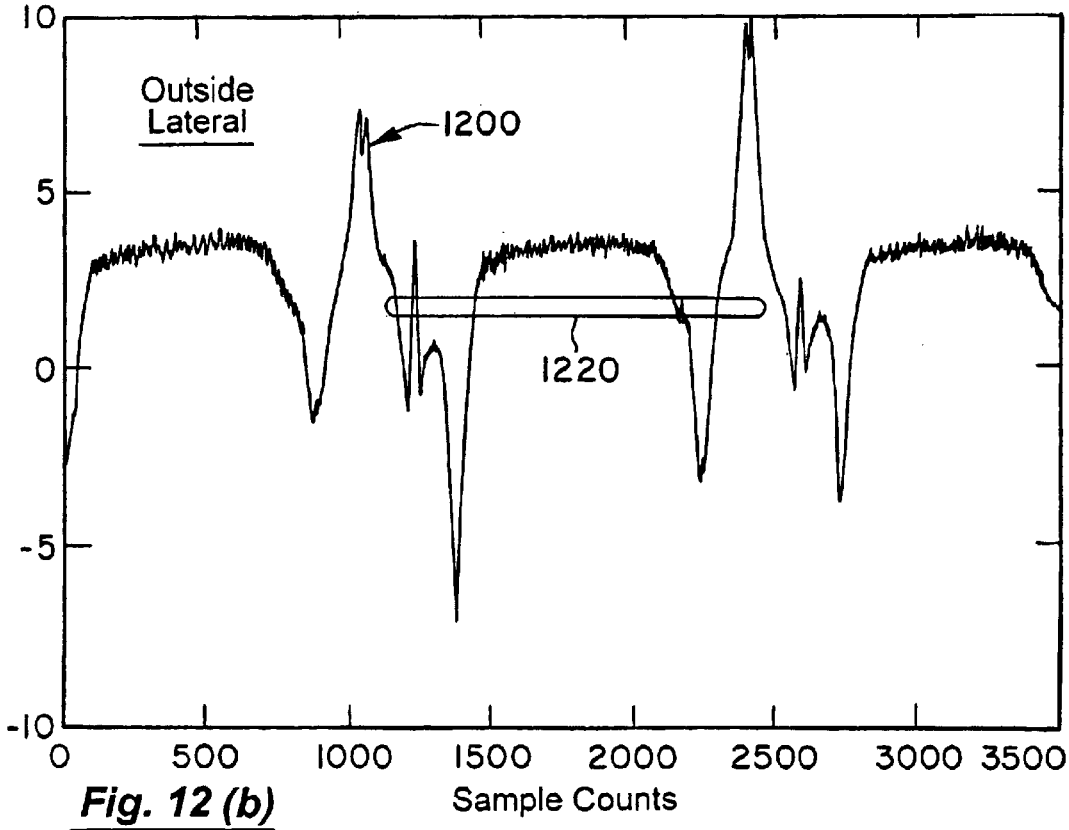
Figure 13A:
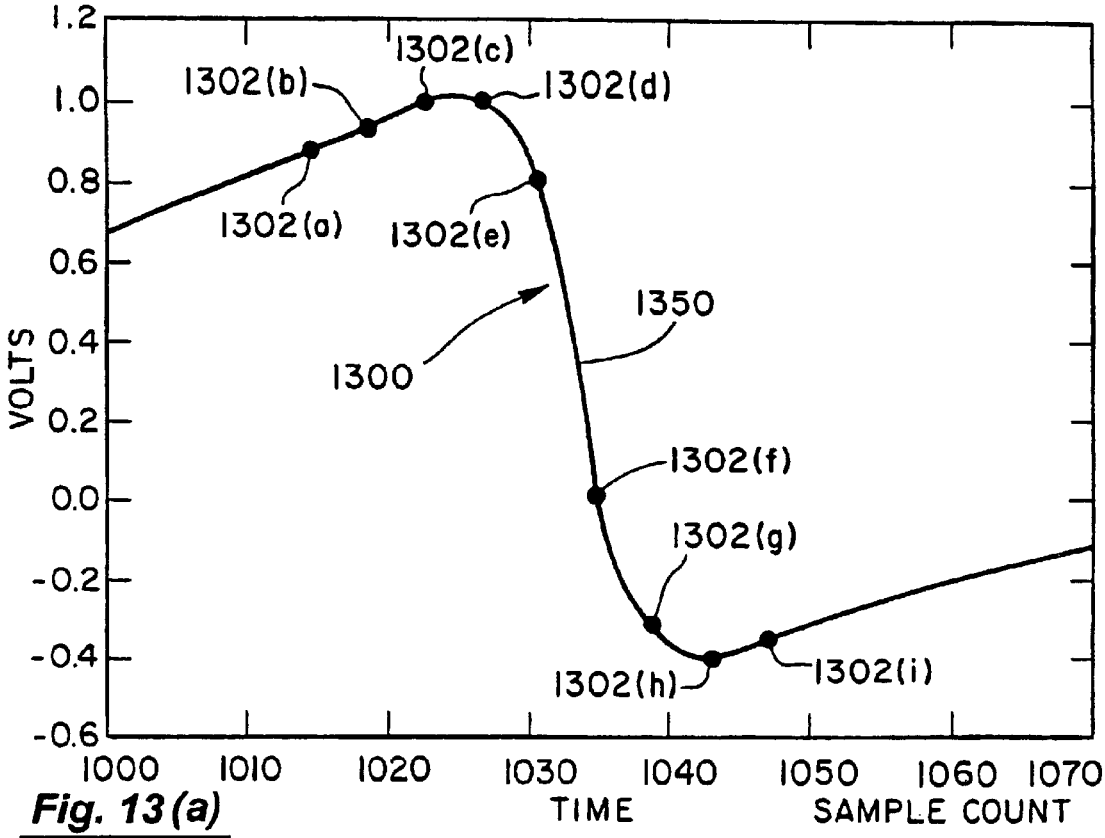
FIG. 13(*a*) sets forth measurement of the angle of attack.
Figure 13B:
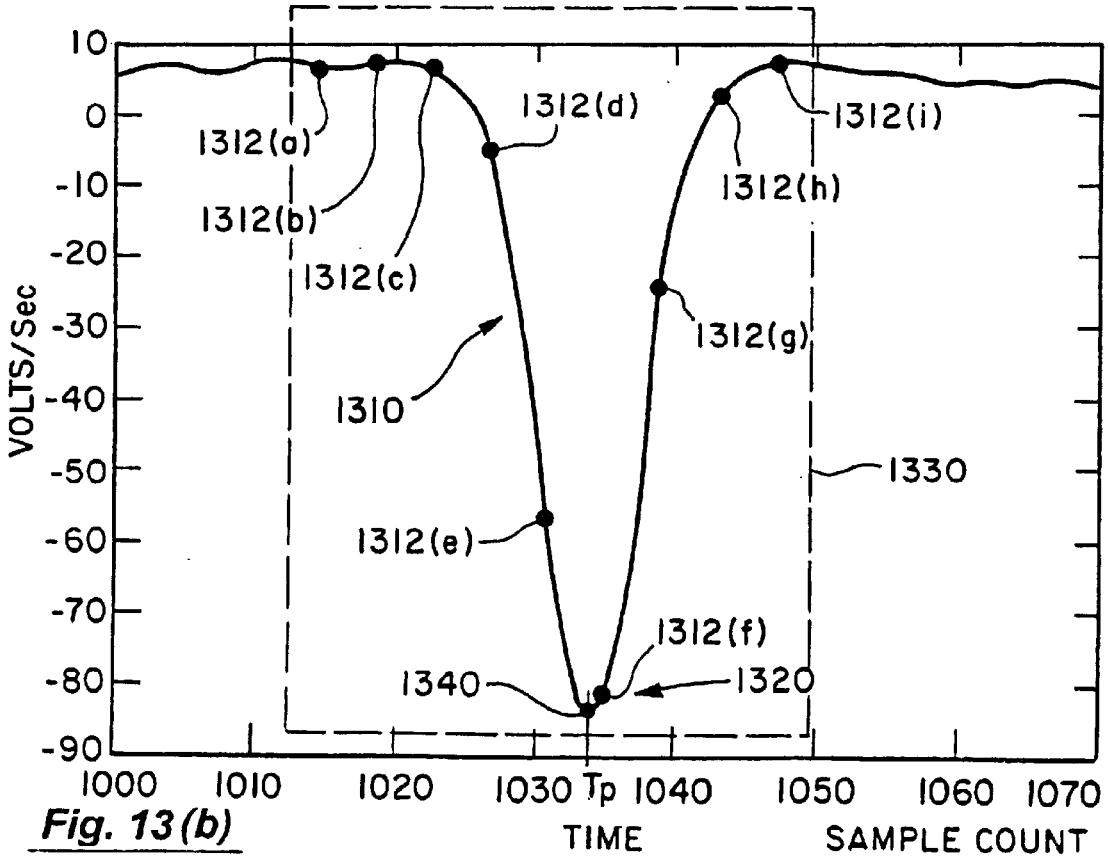

In stage 910 of FIG. 9 the $F_V$ digital values are processed to identify the vertical peak. As the wheel passes over the vertical strain bridge comprised of gages 700, 710, 720, and 730 as shown in FIG. 7, a single peak is produced. In FIG. 11(*a*), an example of $F_V$ data is shown. In FIG. 11(*a*) the passage of the wheel over vertical strain gage in FIG. 7 is shown. The horizontal scale is in suitable time units such as sample counts and the vertical scale is in kilo pounds (KIPS). In FIGS. 11, 12 and 13 the data was collected at 500 samples per second. Curve 1100 in FIG. 11(*a*) is representative of the type of data generated in the present invention for $F_V$. In FIG. 12(*a*), curve 1100 is also shown in conjunction with other wheel passages detected by $F_V$. Hence, in FIG. 12(*a*), two adjacent rail vehicles are shown separated by region 1210. Rail vehicle 1220 has trucks 1222 and 1224. With respect to stage 910, the process of the present invention determines a peak value 1130 (FIG. 11(*a*)) occurring at time 1140 for $F_{VO}$ (i.e., outside rail 10). This represents the approximate time that the wheels pass over point 640 of the vertical strain gages 700, 710, 720, and 730 shown in FIG. 7.

Hence, in stage 910, the peak for $F_{VO}$, shown as 1130 in FIG. 11(*a*), is ascertained which in turn determines the time 1140 for the peak 1130. With knowledge of time 1140, the corresponding value for the lateral force, $F_{LO}$ (i.e., outside rail 10) is ascertained. In FIG. 11(*b*), the lateral force, $F_{LO}$, curve 1200 is shown as received from the lateral strain gages 800, 810, 820, and 830 shown in FIG. 8. At time 1140, the value 1210 of the lateral force, $F_{LO}$, is obtained. This value of lateral force occurs with the peak value 1130 of the vertical force at the same time 1140. In this fashion, the values for $F_L$ and $F_V$ for the rails 10, 20 are determined and the ratio between the lateral force to the vertical force (i.e., $F_L$ divided by $F_V$) is computed for each wheel on each rail.

In stage 920, the speed S for each wheel set is determined. As mentioned, the preferred embodiment shown in FIG. 10 locates the vertical strain gages $F_{V1}$–$F_{V12}$ in wayside units 410 along the track 1000 at known distances. From this information, the speed S can be computed for each wheel set. The determination of speed in stage 920 is important in determining AOA. The speed information is also used in other operations such as computing the spacing of the axles or car type, etc. The speed S is calculated for each wheel set since the speed may change as it passes over a set of gages at each wayside station 410. Hence, the speed S is determined for each wheel set.

In stage 930, the identification of the car type occurs. In stage 930, the computer accesses a car type library database 940 which contains all relevant car types, axle spacings, the weight of the car both empty and loaded. Based upon the speed of each wheel set, the precise time is known between the peaks from the vertical strain gages so that the distance between the wheel sets in a truck can be determined (see FIG. 12(*a*) and arrow 1250 for such a spacing). Based upon this precise spacing, the car type is obtained from the car type library 940. Such car type data is conventionally available for wheel set spacings or such car type data can be compiled from the actual data read for each car type under the teachings of the present invention. The latter is preferred as the car type is based on actual measurements.

In stage 950, the computer 432 of the present invention finds the AOA peak time as follows. In FIG. 13(*a*), an example of the AOA strain gage output (FIG. 6) is shown over time. In stage 950, the derivative of curve 1300 is taken by the process of the present invention. This provides curve 1310 and results in a peak 1320 as shown in FIG. 13(*b*). As an illustration of the sample rate, data points 1302 in FIG. 13(*a*) are obtained. The system of the present invention takes the derivative of the data obtained in FIG. 13(*a*) from the AOA strain gage and produces corresponding data points 1312 in FIG. 13(*b*). These data points 1312 do not indicate the position 1340 of the peak 1320 so a time window 1330 is used around each peak 1320 to find the time point $T_P$ of maximum value 1340 for the derivative. The derivative point 1340 corresponds to the maximum slope 1350 of the signal 1310, which in turn corresponds to the time when the wheel is directly over the AOA gage at point 640.

In reviewing FIG. 13(*b*), it is noticed that this point 1340 is between two data points 1312(*e*) and 1312(*f*). The process of the present invention in stage 950 uses a conventional polynomial fit for the data points in window 1330 surrounding the peak 1320 to arrive at this value 1340 at time $T_P$. It is to be expressly understood that other mathematical approaches could be utilized to process the data points 1312 to arrive at the peak value of 1340. Furthermore, it is to be expressly understood that greater sampling rates would result in a more accurate curve 1300. This determination of value 1340 occurs for each peak 1340 for each AOA gage reading for each wheel on each rail.

In step 950, the method of the present invention converts the wave 1300 in FIG. 13(*a*) to its derivative 1310 and estimates wave 1300's maximum slope 1350 using a polynomial fit. This estimation is necessary because the signal is sampled and not continuous. In summary, the method of the present invention measures the angle of attack for a set of wheels 40 and 50 on the inside and outside rails 20 and 10 of track. This is accomplished by obtaining (sensors $AOL_o$ and $AOL_I$) angle of attack time sampled data 900 for each wheel in the set of wheels. Then, taking a derivative (FIG. 13(*b*)) of the time sampled data for each wheel. The peak 1320 is located and the time sampled data 1312, in a predetermined window 1330, is selected so that the actual peak value 1340 can be calculated such as by a polynomial fit process. This determines time $T_P$ 950 so that the raw AOA can be determined as discussed next.

In stage 960, the raw angle of attack for each set of AOA strain gages on opposing rails 10 and 20 is determined. With reference back to FIG. 1, the raw angle of attack is determined between lines 80 and 90. In FIG. 1, wheel 50 (leading wheel when the train moves in the direction M) will cross the AOA strain gage on outside rail 10 first in time. When this occurs, the system determines the precise time $T_{P0}$ (the time wheel 50 passes the AOA strain gage point 640 located on the outside track 10). The system of the present invention then detects and determines $T_{PI}$ (the time when wheel 40 crosses the strain gage point 640 on the inside track 20). The raw angle of attack is computed from this time difference, the distance $D_R$ between rails 10 and 20 (see FIG. 5) and the speed S of the wheel set. This calculation is determined using conventional small angle approximation (i.e., theta in radians equals the tangent of theta). This determination of the raw AOA occurs for each wheel set (i.e., axle).

In stage 990, high accuracy values for $F_V$, $F_L$ and POS are determined by removing mutual cross-talk values from each value produced in stage 900. FIG. 16 depicts the relationship between the observed signals at strain gages and the actual forces and position on the rail. In an ideal system, $a_{VV}=a_{LL}=a_{PP}=1$ and all other terms=0. Such a system would have signals directly equal to the forces and position they correspond to. In actual systems, however, the terms $a_{VV}\neq a_{LL}\neq a_{PP}\neq 1$ and all other terms are not=0. Such an actual system would have signal composed of percentages of $F_V$, $F_L$ and POS.

If the cross-talk terms were always constant, i.e., not variable with the magnitudes of $F_V$, $F_L$ or POS, then the signals may be resolved into high accuracy values by using the matrix in FIG. 16 and solving for $F_V$, $F_L$ and POS as depicted in FIG. 17. In FIG. 16, the "signals" are voltages obtained from the strain gages and where:

$F_V$, $F_L$, POS are actual forces and positions, and $a_{ij}$=are cross-talk terms (e.g., $a_{VP}$, $a_{LP}$, etc.) between $F_V$, $F_I$ and POS.

This method may not be sufficient if the cross-talk terms are not linear in which case more complex algorithms—such as conventional iterative methods—are used.

The cross-talk terms—whether constants in a matrix as in FIG. 16—or more complex relationships must be determined by a calibration exercise conducted on each set of cases (416*a* through 416*h*) as depicted in FIG. 8. The calibration process consists of a sequence of vertical and lateral loads applied at various positions on the railhead. Graphs of the system responses yield the cross-talk relationships.

Figure 18:
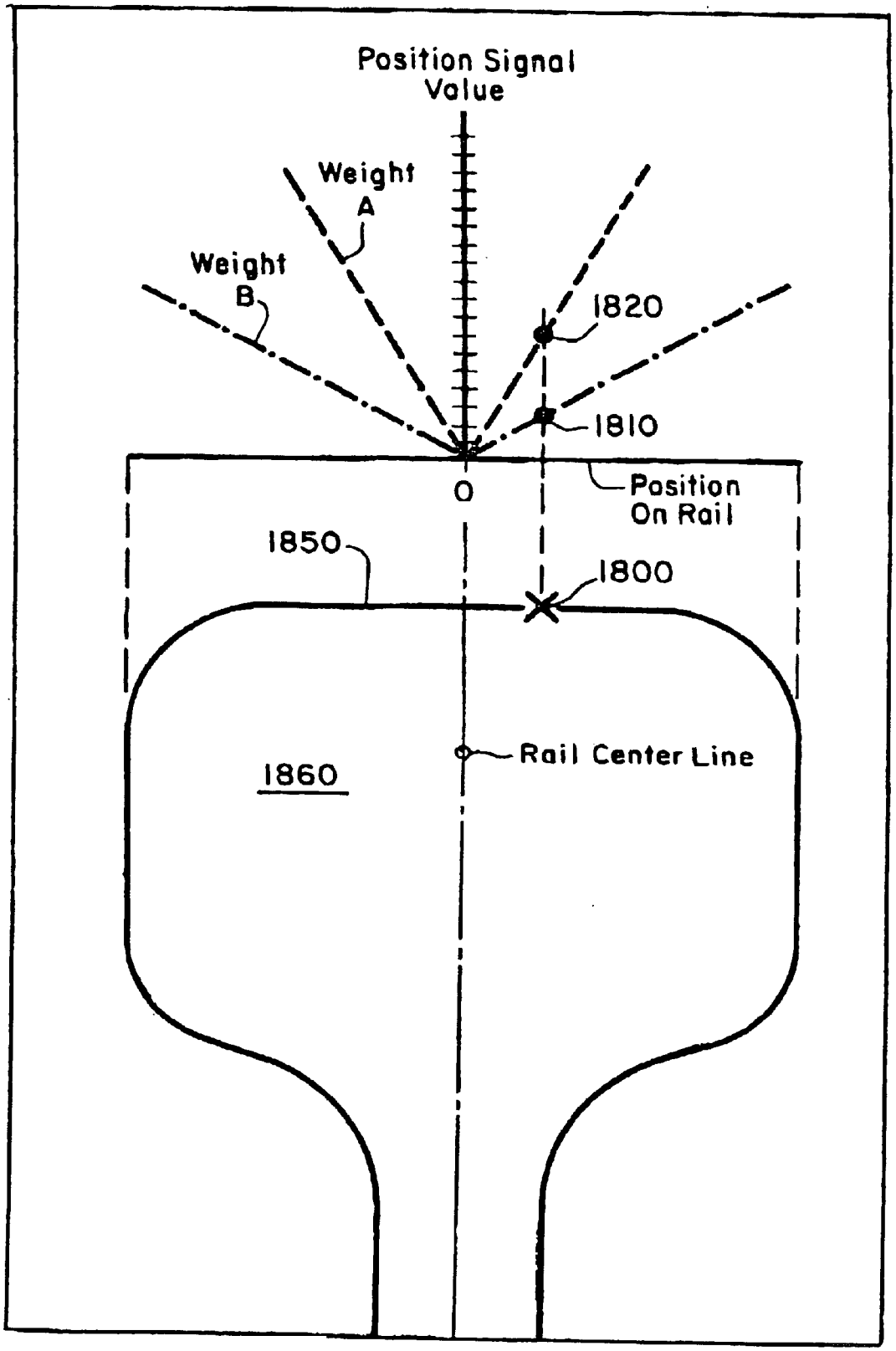
FIG. 18 sets forth a graph showing the effect of vertical load on the railhead as sensed by the position sensors of the present invention.

In FIG. 18 is an illustrative graph showing the POS signal from the strain gage pairs for one rail as shown, for example in FIG. 15 as POSo. In FIG. 18, two different vertical loads are applied to the surface of the railhead. The first load, weight A, is greater than a second load, weight B. When either weight A or B is precisely over the center of the railhead (i.e., "position on the rail"=0), the "position signal"=0. As the loads move to either side of the railhead, the "position signal" increases as shown and the "position signal" is proportional to deflection of bending of the railhead due to the load. As witnessed in FIG. 18, the heavier load A produces a larger value for the "position signal." For example, at position 1800, weight B has a position value of 1810 and weight B has a position value of 1820. The shape of the surface 1860 of the railhead 1860 also affects the values for the "position signal" and this shape is compensated for during the calibration process. For example, a vertical load is applied at a plurality of positions (such as four) on the surface 1860 via a hydraulic pump which a load continuously from 0 to 25,000 lbs and the output signal POS is measured. Lateral forces, for calibration, are applied at a plurality of positions on the railhead for a number of fixed values of vertical force.

Stage 990 is used to improve the observed signal accuracy and to support stages 970 and 980 in FIG. 9 which depend upon accurate estimates of $F_L=F_V$. This stage 990 is particularly important for shallow curves (Radius>1,000 meters) or with light vehicles since $F_L$ is small in value. Stage 990 finds application in any system and method measuring the lateral, vertical and/or AOA forces between a railway wheel set and the railhead of underlying track. Stage 990 removes cross-talk from the raw sensed data for vertical, lateral, and/or AOA sensors. The present invention is not limited to removing cross-talk in AOA measuring systems for shallow curves whether they are the conventional static or the dynamic AOA systems discussed herein.

In stage 970, dynamic angular misalignment is determined. In the actual rail environment, the rails 10 and 20 may move in response to soil movement, thermal expansion, defective wheels, tractive forces, actual physical movement of the rails by the rail vehicles and the loads they may or may not carry (which may change from rail vehicle to rail vehicle in the train), etc. Hence, and with reference to FIG. 5, the strain gages $AOA_O$ and $AOA_I$ may not align precisely along line 80 and may well vary dynamically from wheel axle to wheel axle as set forth next.

In FIG. 14(*b*), the actual position of strain gages $AOA_0$ and $AOA_I$ may not be perfectly aligned along line 80 and may in fact be aligned along parallel lines 80*a* and 80*b* to form an angular offset AO or misalignment error. This could be due to a number of reasons such as longitudinal movement as the train passes over, the ground underneath the track shifting, temperature changes, tractive forces, deformation of the rails 10 and 20, vibration by a truck 1400 passing over so as to cause dynamic movement, etc. The latter is certainly a cause of movement due to the significant mechanical vibrations caused by the truck 1400 such as when misaligned, carrying a heavy load, etc. Criteria set forth above based upon the predetermined range has for its purpose to obtain an average for AO based upon each wheel set (for example, 1410 and 1420 in FIG. 14(*a*)) that falls within the predetermined ranges. These are summed together and an average taken to arrive at a value approximating any misalignment due to angular offset AO whether permanent such as structural deformation or dynamic such as longitudinal movement. This AO average value is used for each wheel set in a passing train to determine the dynamic AOA for each wheel set. A passing train can have any number of rail vehicles such as, for example, eighty-five. The next passing train will be used to determine a new AO average value for that train.

Figure 3:
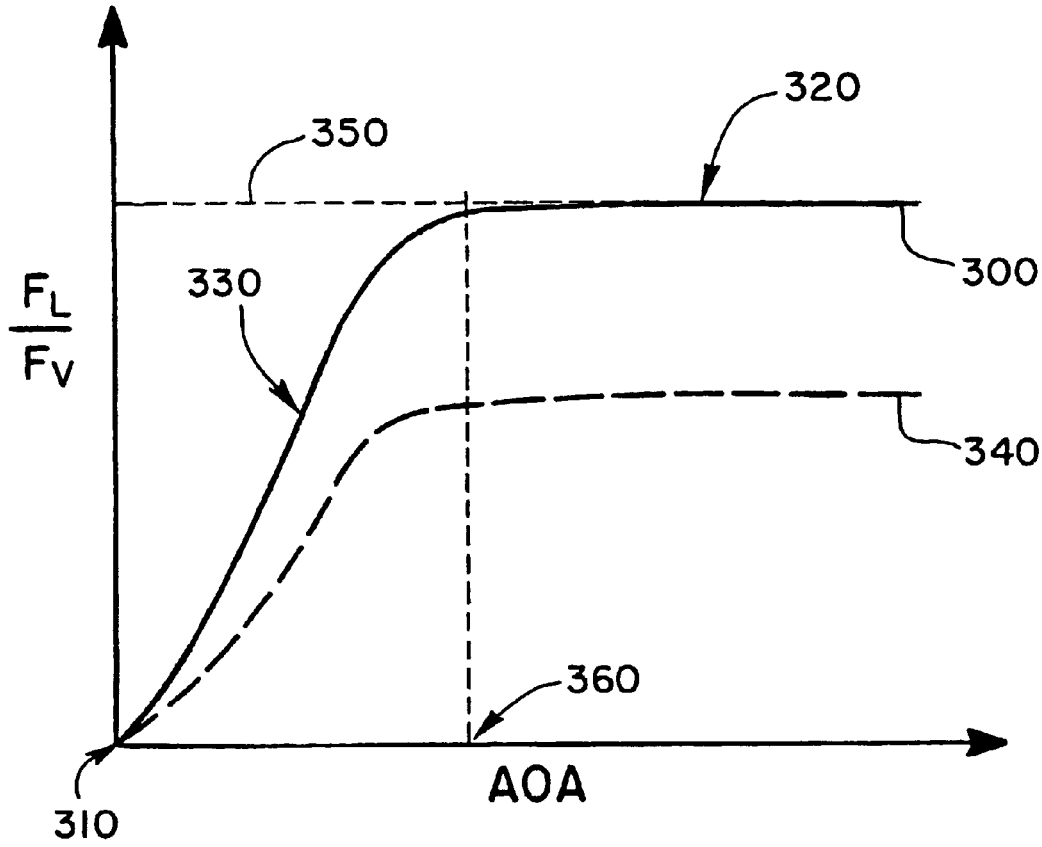
Fig. 3 ( Prior Art )
FIG. 3 is a prior art illustration of the relationship of lateral force to the angle of attack.

The raw AOA from stage 960 includes such gage misalignment (or dynamic angular offset). In step 970, the method goes through all of the "trucks" (i.e., a truck is defined as having two axles, four wheels and associated parts) in the train, and identifies which ones are behaving properly. A truck behaves properly when operating with an AOA near point 310 in FIG. 3. The raw AOA for the trailing axles of such properly steering trucks are averaged together. The average is approximately the dynamic angular offset, which is due to dynamic angular misalignment of the AOA gages (i.e., $AOA_I$ and $AOA_O$ in FIG. 5). This average value is then subtracted from all of the raw AOA values for all axles so as to eliminate this effect. While the above is preferred, other embodiments could approximate the curve 300 near point 310 or provide different average values for different sections of the train.

There are two possible ways, under the teachings of the preferred embodiment, for a truck to be found properly steering. The $F_L$:$F_V$ value on the outside rail 10 for the leading wheel (i.e., wheel 1422 of truck 1400 in FIG. 14(*a*) is used because the outside of a curve experiences the bulk of lateral forces when improperly steering trucks pass through the curve. In the preferred embodiment, the following two selection criteria are used:

1. A truck is selected as properly steering, when the wheel 1422 on the outside rail 10 of the leading axle 1423 has an $F_L$:$F_V$ less than 0.1, or
2. A truck is selected as properly steering, when the wheel 1422 on the outside rail 10 of the leading axle 1423 has an $F_L$:$F_V$ greater than 0.1, but less than 0.17, and, the ratio of trailing $F_L$:$F_V$ to the leading $F_L$:$F_V$ is less than 0.5.

The trailing axle 1413 raw AOA values are summed from the trucks that were accepted by meeting the above predetermined ranges, and the average corresponding to the dynamic angular offset due to misalignment is computed from that. The average is obtained by dividing the sum, by the number of selected trailing axles 1413 in step 970.

The rational behind using these two criteria for selecting trucks, is as follows.

1. If a truck is steering properly both its leading 1423 and trailing 1413 axles should have low $F_L$:$F_V$ values, with the leading axle 1423 having a higher $F_L$:$F_V$ than the trailing axle 1413. If a leading axle 1423 is below some selected threshold, then its trailing axle 1413 should be steering properly, and should be practically perpendicular to the rails 10 and 20. A threshold value of $F_L$:$F_V$= 0.1 satisfies this criteria.
2. If a leading 1423 axle's $F_L$:$F_V$ is above the threshold of 0.1 used in step #1, but below a somewhat higher threshold value (e.g., 0.17), the truck is still selected if the trailing 1413 axle's L/V is less than half of the leading $F_L$:$F_V$.

It is to expressly understood that the above represents a preferred embodiment and that either the first range or second range, in some embodiments, could solely be used. Further, the actual range values of 0.1 and 0.17 and ratio of 0.5 could also vary dependent upon the train/rail design especially found such as in other countries.

The range of values of 0.1 and 0.17 and the ratios of 0.5 are all effected by the actual values of $F_L$ and $F_V$ resolved by the system. If $F_L$ and/or $F_V$ are small values then they may be of the same order of magnitude as the cross-talk between them. Hence stage 990 allows for proper selection of axles for the determination of the dynamic angular offset. Step 970 dynamically determines an average angular offset value due to misalignment of the strain gages $AOA_O$ and $AOA_I$, as shown in FIG. 5. While averaging is used, other mathematical processes could be used to estimate the angular offset value.

In stage 980, the method of the present invention uses the average angular offset value as determined above for dynamic misalignment in step 980 to determine the actual dynamic AOA values for each axle. The average angular offset value is now subtracted from each raw AOA values obtained in step 950 and this results in a dynamic AOA value for each axle.

It is to be understood that while FIG. 9 sets forth a preferred method of the present invention, that the actual sequence of steps set forth therein may change or be done in different processing loops such as in a two pass processing loops, etc.

In FIG. 14(*a*), a truck 1400 of a rail vehicle is shown having a leading axle set 1420 and a trailing axle wheel set 1410. Axle wheel set 1410 has an outside wheel 1412 and an inside wheel 1414. Axle wheel set 1420 has an outside wheel 1422 and inside wheel 1424. In FIG. 14(*a*) the trailing wheel set 1410 of truck 1400 moving in the direction M forms an angle of attack AOA as determined by gages $AOL_O$ and $AOL_I$ as previously discussed. The earlier leading wheel set 1420 of the truck 1400 had formed an angle of attack AOA which was measured by strain gages $AOA_0$ and $AOA_I$.

The method of the present invention may be stated in another way from the viewpoint of time:

$$\Delta T_{RAW}=\Delta T_{AOA}+\Delta T_{AO} \qquad \text{FORMULA 1}$$

where $\Delta T_{RAW}$=The time difference in FIG. 14(*a*) between an outside wheel passing over $AOA_O$ and an inside wheel on the same axle passing over $AOA_I$.

$\Delta T_{AO}$=The time difference caused by misalignment of the $AOA_O$ and $AOA_I$ gages shown in FIG. 14(*b*).

$\Delta T_{AOA}$=The time difference due to the angle of attack.

$$\Delta T_{AOA}=\Delta T_{RAW}-\Delta T_{AO} \quad \text{FORMULA 2}$$

As shown in Formula 2, the time difference due to misalignment is estimated according to the method of the present invention and subtracted from the raw time. The remaining time difference is due to the angle of attack. The delay due to the angle of attack is also a function of speed since the delay time becomes smaller at higher speeds. Formulas 1 and 2 could be expressed in angles if speed and time datas were already converted to angles.

It is to be expressly understood that other approaches such as statistical methods could be taken such as obtaining a median, and that any mathematical approach for estimating these angular offsets due to misalignment of transducers $AOA_O$ and $AOA_I$ could be utilized under the teachings of the present invention.

Once the determination of the peak 1320 in FIG. 13(*b*) (i.e., maximum slope 1350 in FIG. 13(*a*)) has been estimated to arrive at time $T_P$, then the effects of AO and speed S also are estimated. The predetermined ranges (i.e., selection criteria) assume that these axles steer properly with small angles of attack have small lateral forces. The inverse assumption (i.e., small lateral forces have small angles of attack) is implied, but not necessarily true since small weights or low friction can reduce lateral forces even in the presence of high angles of attack. However, the method of the present invention selects the wheels with small lateral forces and estimates what a zero angle of attack is in terms of time delay so as to arrive at an average AO value due to misalignment of $AOA_O$ and $AOA_I$ on the rails whether the misalignment is static, dynamic, or both. The average AO value is then used for the entire train.

In summary, a method for measuring the dynamic angle of attack for the leading and trailing sets of wheels in trucks of rail vehicles has been disclosed. Under the preferred embodiments the raw angles of attack for all sets of wheels are determined in stage 960. The method 990 then refines the estimates of FV and FL by using POS to remove cross-talk thereby providing higher accuracy. The method 970 then selects only those raw angles of attack for trucks on the track within a measured predetermined range (or value) of lateral to vertical force ratios. The selected trucks are trucks properly steering on the track. The method then calculates a dynamic angular offset value based on the selected raw angles of attack. The method 980 then subtracts the offset value from the raw angles of attack for all sets of wheels to arrive at a dynamic angle of attack for each wheel set.

It is to be expressly understood that while the above discussion has been directed towards rail cars that have four axles, that the teachings of the present invention would apply to locomotives that have six axles or even to other types of vehicles having wheels on track.

The removal of cross-talk as set forth above can be utilized in any system and method measuring the vertical and/or lateral forces between a railway wheel set and the railhead of underlying track. In summary, a method for measuring force between a railway wheel set of a rail vehicle and the railhead of underlying track is set forth. The present invention obtains force data for at least one wheel in the set of wheels of the rail vehicle at a known position on the underlying track. Position data is also sensed at the position on the underlying track that the force data was obtained. The sensed position data is calibrated to the shape of the surface of the railhead at the position and the weight of the rail vehicle at the position and is used to remove cross-talk from the obtained force data. The resulting force value with the cross-talk removed is highly accurate.

The above disclosure sets forth a number of embodiments of the present invention. Those skilled in this art will however appreciate that other arrangements or embodiments, not precisely set forth, could be practiced under the teachings of the present invention and that the scope of this invention should only be limited by the scope of the following claims.

We claim:

1. A method for approximating an angular offset error in dynamic angle-of-attack measurements for train moving along track comprising:

measuring the angle-of-attack value for at least one pair of opposing wheels in each wheel set in a given number of wheel sets of said train at a location on said track having opposing sensors, said opposing sensors offset from each other due to misalignment so that each sensor is misaligned along parallel lines perpendicular to the track rather than being aligned on a single line, the misalignment due to rail longitudinal movement, determining in a computer operatively connected to said opposing sensors the approximate angular offset error based on the measured angle of attack values for each wheel set in the given number of wheel sets, selecting only those measured angle-of-attack values that fall within a predetermined range, the predetermined range selected to correspond to include properly steering wheel sets in the given number of wheel sets, processing the selected angle-of-attack values to obtain the approximate angular offset value.

2. The method of claim 1 wherein the given number is all wheel sets in said train.

3. The method of claim 1 wherein each pair of opposing wheels in each wheel set is measured.

4. The method of claim 1 wherein the rail longitudinal movement is due to permanent longitudinal shifting of at least one rail of said track.

5. The method of claim 1 wherein the rail longitudinal movement is due to dynamic movement of at least one rail of said track.

6. The method of claim 1 wherein determining comprises:

selecting only those measured angle-of-attack values that fall within a predetermined range, the predetermined range selected to correspond to include properly steering wheel sets in the given number of wheel sets, processing the selected angle-of-attack values to obtain the approximate angular offset value.

7. The method of claim 6 wherein the predetermined range at least includes wheel sets having a wheel on one rail of said track of a leading axle in the wheel set with a $F_L$:$F_V$ less than 0.1, where $F_L$ is based on a reading from a lateral strain gage and $F_V$ is based on a reading from a vertical strain gage.

8. The method of claim 6 wherein the predetermined range at least includes wheel sets having a wheel on one rail of said track of a leading axle in the wheel set with a leading $F_L$:$F_V$ greater than 0.1, but less than 0.17 where $F_L$ is based on a reading from a lateral strain gage and $F_V$ is based on a reading from a vertical strain gage and wherein the ratio of the trailing $F_L$:$F_V$ to the leading $F_L$:$F_V$ is less than 0.5.

9. The method of claim 6 wherein the predetermined range is based on a time difference between a wheel and an opposing wheel passing over said parallel lines.

10. The method of claim 6 wherein the processing averages the selected angle-of-attack values.

11. The method of claim 6 wherein the processing determines a mean of the selected angle-of-attack values.

12. A method for approximating an angular offset error in dynamic angle-of-attack measurements for train moving along track comprising:

measuring the angle-of-attack value for at least one pair of opposing wheels in each wheel set in a given number of wheel sets of said train at a location on said track having opposing sensors, said opposing sensors offset from each other due to misalignment so that each sensor is misaligned along parallel lines perpendicular to the track rather than being aligned on a single line, the misalignment due to rail longitudinal movement, selecting only those measured angle-of-attack values that correspond to properly steering wheel sets in the given number of wheel sets, processing in said computer the selected angle-of-attack values to obtain the approximate angular offset value.

13. The method of claim 12 wherein the given number is all wheel sets in said train.

14. The method of claim 12 wherein each pair of opposing wheels in each wheel set is measured.

15. The method of claim 12 wherein the predetermined range at least includes wheel sets having a wheel on one rail of said track of a leading axle in the wheel set with a $F_L$:$F_V$ less than 0.1, where $F_L$ is basted on a reading from a lateral strain gage and $F_V$ is based on a reading from a vertical strain gage.

16. The method of claim 12 wherein the selected values at least includes wheel sets having a wheel on rail of said track of a leading axle in the wheel set with a leading $F_L$:$F_V$ greater than 0.1, but less than 0.17 wherein $F_L$ is based on a reading from a lateral strain gage and $F_V$ is based on a reading from a vertical strain gage and wherein the ratio of the trailing $F_L$:$F_V$ to the leading $F_L$:$F_V$ is less than 0.5.

17. The method of claim 12 wherein the selected values is based on a time difference between a wheel and an opposing wheel passing over said parallel lines.

18. The method of claim 12 wherein the processing averages the selected angle-of-attack values.

19. The method of claim 12 wherein the processing determines a mean of the selected angle-of-attack values.

* * * * *